US010229656B2

(12) United States Patent
Takahashi et al.

(10) Patent No.: US 10,229,656 B2
(45) Date of Patent: Mar. 12, 2019

(54) IMAGE PROCESSING APPARATUS AND IMAGE PROCESSING METHOD TO DISPLAY FULL-SIZE IMAGE OF AN OBJECT

(71) Applicant: SONY CORPORATION, Tokyo (JP)

(72) Inventors: Shuichi Takahashi, Kanagawa (JP); Yoshiyuki Akiyama, Kanagawa (JP); Kazuki Yokoyama, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 101 days.

(21) Appl. No.: 15/314,936

(22) PCT Filed: Mar. 27, 2015

(86) PCT No.: PCT/JP2015/001779
§ 371 (c)(1),
(2) Date: Nov. 29, 2016

(87) PCT Pub. No.: WO2015/194075
PCT Pub. Date: Dec. 23, 2015

(65) Prior Publication Data

US 2017/0193970 A1 Jul. 6, 2017

(30) Foreign Application Priority Data

Jun. 18, 2014 (JP) ..... 2014-125085

(51) Int. Cl.
*G09G 5/00* (2006.01)
*G09G 5/373* (2006.01)
(Continued)

(52) U.S. Cl.
CPC ..... *G09G 5/373* (2013.01); *G09G 5/00* (2013.01); *G09G 5/36* (2013.01); *G09G 5/38* (2013.01);
(Continued)

(58) Field of Classification Search
CPC ..... G06T 3/40
See application file for complete search history.

(56) References Cited

U.S. PATENT DOCUMENTS 9,946,320 B2 * 4/2018 Zhao ..... G06F 1/3206
2009/0009511 A1 * 1/2009 Ueda ..... H04N 5/4401 345/419
(Continued)

FOREIGN PATENT DOCUMENTS

JP 06-269008 A 9/1994
JP 2000-224459 A 8/2000
(Continued)

OTHER PUBLICATIONS

Noriko Kurachi, "The Fusion of AI Technology and Image-based Technology", CG Technology, Photo Clip Art Chapter 2, CORE, vol. 7, No. 119, Jan. 7, 2008, pp. 74-77.
(Continued)

*Primary Examiner* — Phi Hoang
(74) *Attorney, Agent, or Firm* — Chip Law Group

(57) ABSTRACT

To provide an image processing apparatus, an image processing method, and a program with which a full-size image of an object in an input image can be displayed at a position that makes people feel that the image is closer to the real thing. An image processing apparatus according to an embodiment of the present technology includes an image size adjustment unit and a display position determination unit. The image size adjustment unit adjusts a size of an input image so that an object of the input image is displayed in full size from a display area. The display position determination unit determines, on the basis of a positional relationship between a first base surface of a space where the display area exists and the display area, a display position of
(Continued)

a full-size image in the display area, the full-size image being obtained by adjusting the size of the input image.

10 Claims, 18 Drawing Sheets

(51) Int. Cl.
*G09G 5/36* (2006.01)
*G09G 5/38* (2006.01)

(52) U.S. Cl.
CPC ..... *G09G 5/005* (2013.01); *G09G 2340/0464* (2013.01); *G09G 2370/04* (2013.01)

(56) References Cited

U.S. PATENT DOCUMENTS

2012/0050458 A1 3/2012 Mauchly et al.
2014/0132511 A1* 5/2014 Ahn ..... G06F 3/013 345/158
2014/0211091 A1* 7/2014 Ida ..... H04N 5/44513 348/563
2015/0350804 A1* 12/2015 Crockett ..... H04R 5/02 381/307

FOREIGN PATENT DOCUMENTS

JP 2000-358222 A 12/2000
JP 3586126 B2 11/2004
JP 2009-017279 A 1/2009
JP 2011-077710 A 4/2011
JP 2012-190265 A 10/2012
WO 2014/069112 A1 5/2014

OTHER PUBLICATIONS

"The production of 3D content", pp. 168-170.
Noriko Kurachi, "The Fusion of AI Technology and Image-based Technology", CG Technology, CORE, vol. 7, No. 119, Jan. 7, 2008, pp. 74-77.

* cited by examiner

IMAGE PROCESSING APPARATUS AND IMAGE PROCESSING METHOD TO DISPLAY FULL-SIZE IMAGE OF AN OBJECT

CROSS REFERENCE TO RELATED APPLICATIONS

This application is a U.S. National Phase of International Patent Application No. PCT/JP2015/001779 filed on Mar. 27, 2015, which claims priority benefit of Japanese Patent Application No. JP 2014-125085 filed in the Japan Patent Office on Jun. 18, 2014. Each of the above-referenced applications is hereby incorporated herein by reference in its entirety.

TECHNICAL FIELD

The present technology relates to an image processing apparatus, an image processing method, and a program with which an object of an input image can be displayed in full size.

BACKGROUND ART

From the past, apparatuses capable of displaying an object of an input image in full size, and the like have been known. For example, Patent Document 1 discloses a full size image input/output device that calculates a display size of a captured image on the basis of a distance between a camera and an object, an angle of view of a photographing lens, and the like, and displays the object in full size. On the other hand, Patent Document 2 discloses a video communication system that separates a person (persons) and a background from a 2D video taken with a camera and converts the 2D video into a multilayer video to generate a full-size 3D video having a depth.

Patent Document 1: Japanese Patent No. 3586126

Patent Document 2: Japanese Patent Application Laid-open No. 2011-77710

SUMMARY

Problem to be Solved

In Patent Documents 1 and 2 respectively disclosing the device and system, however, no reference has been made on where to display a full-size image of an object in a display area of a display or the like.

In view of the circumstances as described above, the present technology aims at providing an image processing apparatus, an image processing method, and a program with which a full-size image of an object in an input image can be displayed at a position that makes people feel that the image is closer to the real thing.

Means for Solving the Problem

To attain the object described above, according to an embodiment of the present technology, there is provided an image processing apparatus including an image size adjustment unit and a display position determination unit.

The image size adjustment unit adjusts a size of an input image so that an object of the input image is displayed in full size from a display area.

The display position determination unit determines, on the basis of a positional relationship between a first base surface of a space where the display area exists and the display area, a display position of a full-size image in the display area, the full-size image being obtained by adjusting the size of the input image.

With this configuration, the full-size image of the object can be displayed on the basis of the positional relationship between the first base surface where a user viewing the display area is considered to stand and the display area. As a result, the object displayed in full size from the display area can be captured as being closer to the real thing.

The display position determination unit may include a second base surface information acquisition unit that acquires, from the full-size image, information on a position of a second base surface of a space where the object exists, and determine the display position while enabling the position of the first base surface and the position of the second base surface in the full-size image to match.

With this configuration, it becomes possible to cause the second base surface in the image to match the actual position of the first base surface and make the user feel that the space in the image matches with the actual space. Therefore, the object can be captured as being closer to the real thing.

Specifically, the second base surface information acquisition unit may include a second base surface judgment unit that judges whether the second base surface is captured in the full-size image, and a second base surface detection unit that detects the position of the second base surface from the full-size image when judged that the second base surface is captured in the full-size image.

Further, the image processing apparatus may further include a first base surface detection unit that detects a distance between the display area and the first base surface, and the display position determination unit may determine the display position on the basis of the detected distance.

As a result, it becomes possible to automatically detect the distance between the display area and the first base surface and omit time and effort required for the user to measure the distance.

Further, the display position determination unit may include a gaze area detection unit that detects an area to be gazed by a user out of the full-size image, and determine the display position such that the gaze area in the full-size image can be displayed from the display area.

With this configuration, the display position determination unit can determine not only the height direction of the full-size image but also a position in the horizontal direction and the like.

Further, the image processing apparatus may further include an image information analysis unit that analyzes information of the input image including information on the object, and the image size adjustment unit may adjust the size of the input image on the basis of the information of the input image.

With this configuration, the image size adjustment unit can smoothly and accurately adjust the size of the input image on the basis of the information on the object, a specification of the input image, and the like.

Specifically, the image specification analysis unit may include a metadata acquisition unit that acquires metadata recorded onto the input image, and the image size adjustment unit may adjust the size of the input image on the basis of a specification of the display area and the metadata.

Alternatively, the image specification analysis unit may include an object information acquisition unit that acquires information on a size of the object, and the image size adjustment unit may adjust the size of the input image on the basis of a specification of the display area and the information on the size of the object.

Further, the image processing apparatus may further include a display area specification acquisition unit that acquires a specification of the display area, and the image size adjustment unit may adjust the size of the input image on the basis of the specification of the display area.

With this configuration, the image size adjustment unit can smoothly and accurately adjust the size of the input image on the basis of the specification of the display area.

Further, the image processing apparatus may further include an audio output control unit that controls, on the basis of the determined display position, an output position of audio associated with the full-size image.

With this configuration, audio that may be emitted from the object in the full-size image can be emitted from the vicinity of the object whose display position has been adjusted. As a result, the object in the full-size image can be felt like it is in the same space as a viewer viewing an image in the display area, and thus vividness and a sense of realness can be additionally enhanced.

According to an embodiment of the present technology, there is provided an image processing method including adjusting a size of an input image so that an object of the input image is displayed in full size from a display area.

On the basis of a positional relationship between a first base surface of a space where the display area exists and the display area, a display position of a full-size image obtained by adjusting the size of the input image in the display area is determined.

According to an embodiment of the present technology, there is provided a program that causes an information processing apparatus to execute the steps of:

adjusting a size of an input image so that an object of the input image is displayed in full size from a display area; and determining, on the basis of a positional relationship between a first base surface of a space where the display area exists and the display area, a display position of a full-size image in the display area, the full-size image being obtained by adjusting the size of the input image.

Effects

As described above, according to the present technique, it becomes possible to provide an image processing apparatus, an image processing method, and a program with which a full-size image of an object of an input image can be displayed at a position where a viewer feels that the image is closer to the real thing.

It should be noted that the effects described herein are not necessarily limited, and any effect described in the present disclosure may be obtained.

DESCRIPTION OF PREFERRED EMBODIMENTS

Hereinafter, embodiments of the present technology will be described with reference to the drawings.

First Embodiment (Hardware Configuration of Image Processing Apparatus)

Figure 1:
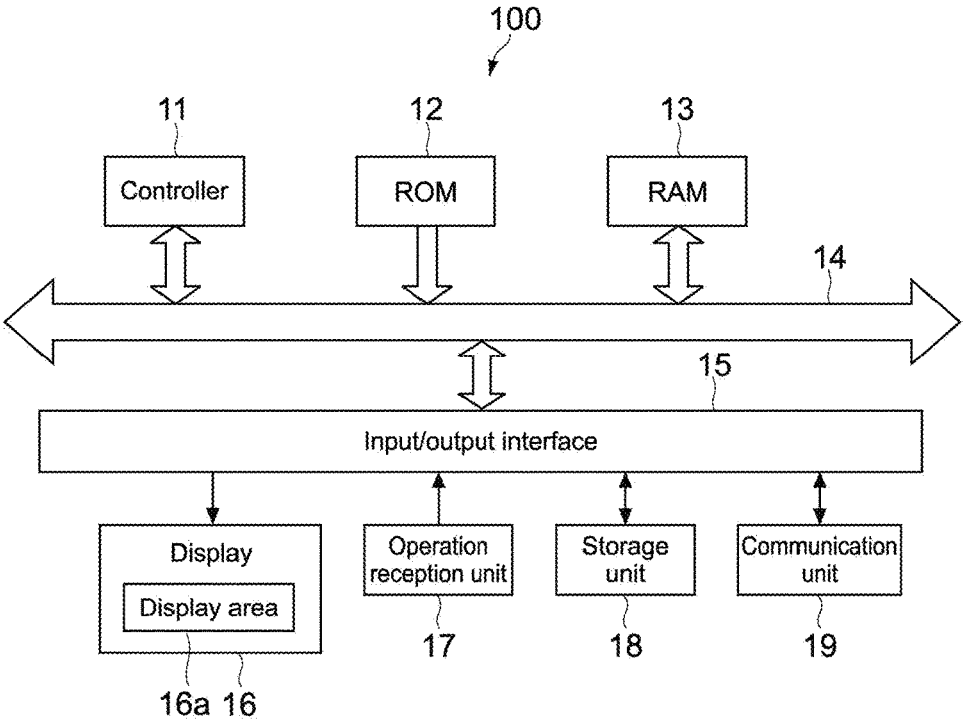
FIG. 1 A block diagram showing a hardware configuration of an image processing apparatus according to a first embodiment of the present technology.

FIG. 1 is a block diagram showing a hardware configuration of an image processing apparatus 100 according to a first embodiment of the present technology. The image processing apparatus 100 is configured as an information processing apparatus in this embodiment. Specifically, the image processing apparatus 100 may be an information processing apparatus such as a PC (Personal Computer), a tablet PC, a smartphone, and a tablet terminal.

In the figure, the image processing apparatus 100 includes a controller 11, a ROM (Read Only Memory) 12, a RAM (Random Access Memory) 13, an input/output interface 15, and a bus 14 mutually connecting them.

The controller 11 appropriately accesses the RAM 13 and the like as necessary and carries out various types of operational processing to collectively control the entire blocks of the image processing apparatus 100. The controller 11 may be a CPU (Central Processing Unit), a GPU (Graphics Processing Unit), or the like. The ROM 12 is a nonvolatile memory that fixedly stores an OS to be executed by the controller 11 and firmware such as programs and various parameters. The RAM 13 is used as a working area of the controller 11 and the like and temporarily stores the OS, various applications being executed, and various types of data being processed.

Connected to the input/output interface 15 are a display 16, an operation reception unit 17, a storage unit 18, a communication unit 19, and the like. It should be noted that in addition to those elements, the input/output interface 15 may be connectable to an external peripheral apparatus via a USB (Universal Serial Bus) terminal, an IEEE terminal, and the like. Moreover, in addition to those elements, an image pickup unit (not shown) and the like may also be connected to the input/output interface 15.

The display 16 is a display device that uses an LCD (Liquid Crystal Display), an OLED (Organic Light Emitting Diode), a CRT (Cathode Ray Tube), or the like. It should be noted that a display area 16*a* that displays an image is demarcated in the display 16.

The operation reception unit 17 is a pointing device such as a mouse, a keyboard, a touch panel, or other input apparatuses. When the operation reception unit 17 is a touch panel, the touch panel may be integrated with the display 16.

The storage unit 18 is a nonvolatile memory such as an HDD (Hard Disk Drive), a flash memory (SSD: Solid State Drive), and other solid-state memories. The OS, various applications, and various types of data are stored in the storage unit 18. The storage unit 18 is capable of storing an input image to be described later, image information, generated space filters, a generated output image group, and the like.

The communication unit 19 is an NIC (Network Interface Card) for the Ethernet (registered trademark), for example, and assumes communication processing via a network.

The image processing apparatus 100 having the hardware configuration as described above includes a functional configuration as follows.

(Functional Configuration of Image Processing Apparatus)

Figure 2:
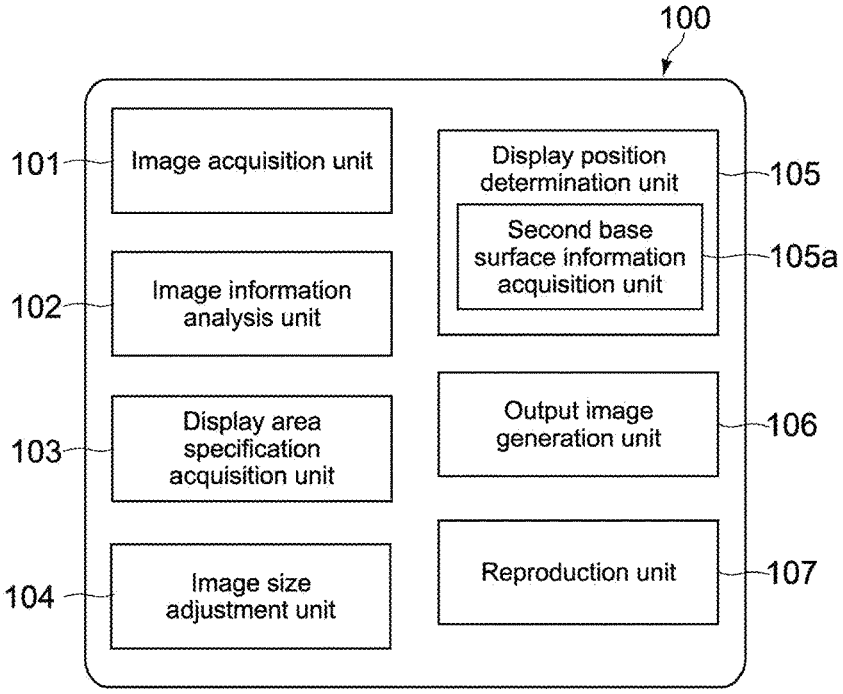
FIG. 2 A block diagram showing a functional configuration of the image processing apparatus.

FIG. 2 is a block diagram showing the functional configuration of the image processing apparatus 100. As shown in the figure, the image processing apparatus 100 includes an image acquisition unit 101, an image information analysis unit 102, a display area specification acquisition unit 103, an image size adjustment unit 104, a display position determination unit 105, an output image generation unit 106, and a reproduction unit 107. The image processing apparatus 100 is capable of displaying an input image in full size and determining a display position of the full-size image such that a ground surface of the full-size image (second base surface to be described later) substantially matches with a floor of a space where the display 16 is placed (first base surface to be described later), for example. It should be noted that the input image used in this embodiment may be, for example, a still image or one frame of a moving image.

The image acquisition unit 101 acquires an input image to be processed. The image acquisition unit 101 is realized by the controller 11, for example. The image acquisition unit 101 acquires an image stored in the storage unit 18 via the input/output interface 15 as the input image, for example. The input image may be, for example, an image taken by the image pickup unit (not shown) of the image processing apparatus 100 or an image that has been taken by an external image pickup apparatus or the like and input to the image processing apparatus 100. Alternatively, the input image may be an image acquired via a network.

The image information analysis unit 102 analyzes information of an input image including information on an object. The image information analysis unit 102 is realized by the controller 11, for example. As an analysis of the information on an object, for example, the image information analysis unit 102 can detect an object area, predict an object type, analyze an actual size of the object, and the like. The prediction of an object type and the detection of an object area can be performed using an image recognition technology, for example. Moreover, the actual size of the object can be predicted on the basis of the predicted object type, for example. In addition to the information on an object, the image information analysis unit 102 is capable of acquiring a specification of an input image such as a resolution (pixel count) of the input image and analyzing it as the information of the input image.

The display area specification acquisition unit 103 acquires a specification of the display area 16*a*. The display area specification acquisition unit 103 is realized by the controller 11, for example. Here, the "specification of the display area 16*a*" includes a specification of the display 16 in which the display area 16*a* is provided. As the specification of the display area 16*a*, the display area specification acquisition unit 103 is capable of acquiring, for example, a size of the display area 16*a*, a resolution (pixel count) of the display area 16*a*, and information on a pixel pitch. In addition, when information on a distance between a lower side of the display area 16*a* and a first base surface B1 is stored in the storage unit 18 and the like, the display area specification acquisition unit 103 can also acquire that information.

The image size adjustment unit 104 adjusts a size of an input image so that an object in the input image is displayed in full size from the display area 16*a*. The image size adjustment unit 104 is realized by the controller 11, for example. Specifically, the image size adjustment unit 104 adjusts the size of the input image by enlarging or reducing, on the basis of the acquired specification of the display area 16*a* and information of the input image, the input image so that the object is displayed in full size from the display area 16*a*. As a result, it is possible to generate a full-size image obtained by enlarging or reducing the input image such that the object is displayed in full size (life size) from the display area 16*a*. The method of adjusting a size is not limited in particular.

The display position determination unit 105 determines a display position of the full-size image obtained by adjusting the size of the input image in the display area 16*a* on the basis of a positional relationship between a first base surface of a space where the display area 16*a* exists and the display area 16*a*. The display position determination unit 105 is realized by the controller 11, for example. Here, the "space where the display area 16*a* exists" refers to an indoor space or outdoor space where the display 16 including the display area 16*a* is located. The "first base surface" refers to a floor in the case where the space is an indoor space and the ground in the case where the space is an outdoor space. The display position determination unit 105 only needs to determine the display position in at least a height direction. With the display position determination unit 105, it is possible to adjust the display position of the full-size image in the display area 16*a* so that the object feels more like the real thing.

When the full-size image is larger than the display area 16*a*, for example, the display position determination unit 105 determines an area of the full-size image to be displayed from the display area 16*a*. Alternatively, when the full-size image is smaller than the display area 16*a*, the display position determination unit 105 determines the position at which the full-size image is to be displayed in the display area 16*a*.

The method by which the display position determination unit 105 acquires the positional relationship between the first base surface and the display area 16*a* is not limited in particular. For example, the display position determination unit 105 can use information on a distance between the lower side of the display area 16*a* and the first base surface, that has been stored in advance as the specification of the display area 16*a* and acquired by the display area specification acquisition unit 103.

In this embodiment, the display position determination unit 105 includes a second base surface information acquisition unit 105*a* and determines the display position while enabling the position of the first base surface to match the position of the second base surface in the full-size image. The "second base surface" is a base surface of a space where an object exists, the second base surface being a floor surface when the space is an indoor space and a ground surface when the space is an outdoor space. The "space where an object exists" refers to an indoor or outdoor space where an object in an input image is predicted to have existed at a time the image was taken. In determining the display position, the display position determination unit 105 can use the information on the input image analyzed by the image information analysis unit 102, the specification of the display area 16*a* acquired by the display area specification acquisition unit 103, and the like. A specific example of the method of determining the display position will be described later.

The second base surface information acquisition unit 105*a* acquires information on a position of the second base surface in the space where the object exists from the full-size image. Specifically, the second base surface information acquisition unit 105*a* judges whether the second base surface is captured in the full-size image using the image recognition technology or the like and when judged that the second base surface is captured, detects a coordinate position of the second base surface in the full-size image. The position of the second base surface can be detected as a straight line parallel to the lower side of the display area 16*a*, for example. Further, when the second base surface is detected as a broadened area, a line where the object is arranged in the area of the second base surface may be specified as the position of the second base surface. Moreover, when judged that the second base surface is not captured in the full-size image, the second base surface information acquisition unit 105*a* can reference information on a vanishing point/vanishing line to predict the coordinate position of the second base surface.

It should be noted that in this embodiment, the display position determination unit 105 can determine only the display position of the full-size image in the height direction. The method of determining a display position in the horizontal direction is not limited in particular.

On the basis of the determined display position, the output image generation unit 106 generates an output image including at least a part of the full-size image. The output image generation unit 106 is realized by the controller 11, for example. The output image generation unit 106 generates the output image as image signals and outputs the image signals to the reproduction unit 107.

The reproduction unit 107 reproduces the output image. The reproduction unit 107 is realized by the display 16, for example.

(Operation Example of Image Processing Apparatus)

Figure 3:
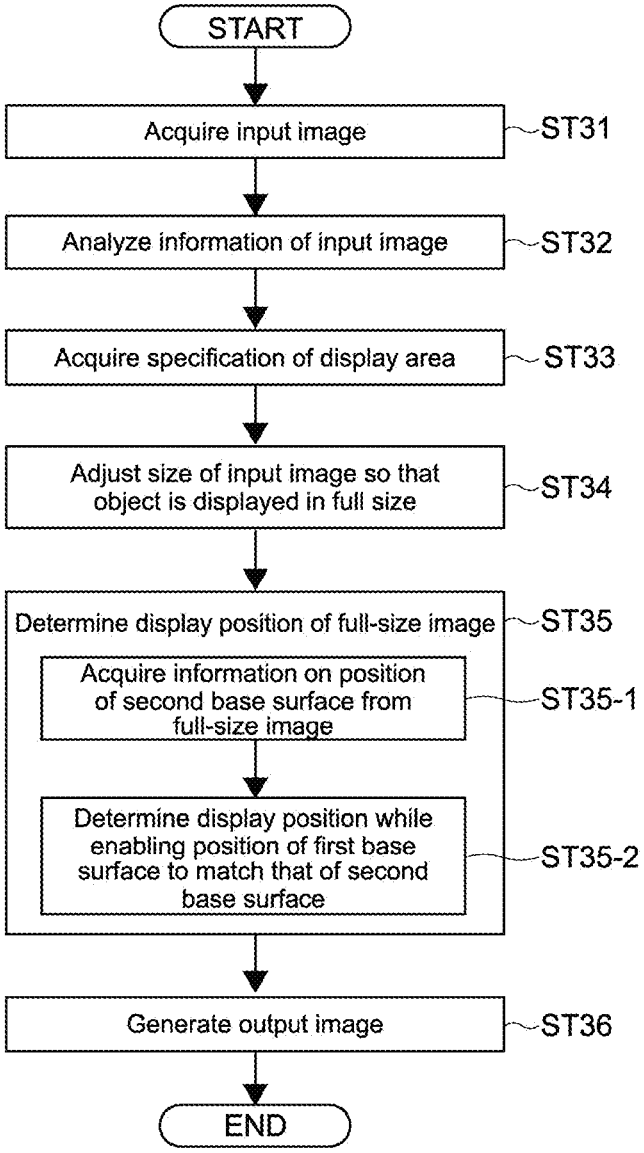
FIG. 3 A flowchart showing operations of the image processing apparatus.

FIG. 3 is a flowchart showing operations of the image processing apparatus 100. Here, the case where the full-size image is larger than the display area 16*a* will be described, but the processing can be carried out similarly in the case where the full-size image is smaller than the display area 16*a*.

First, the image acquisition unit 101 acquires an input image to be processed via the input/output interface 15 (ST31). The input image to be processed is, for example, one still image taken with an image pickup apparatus (not shown) or the like, but it may alternatively be one frame of a moving image.

Figure 4:
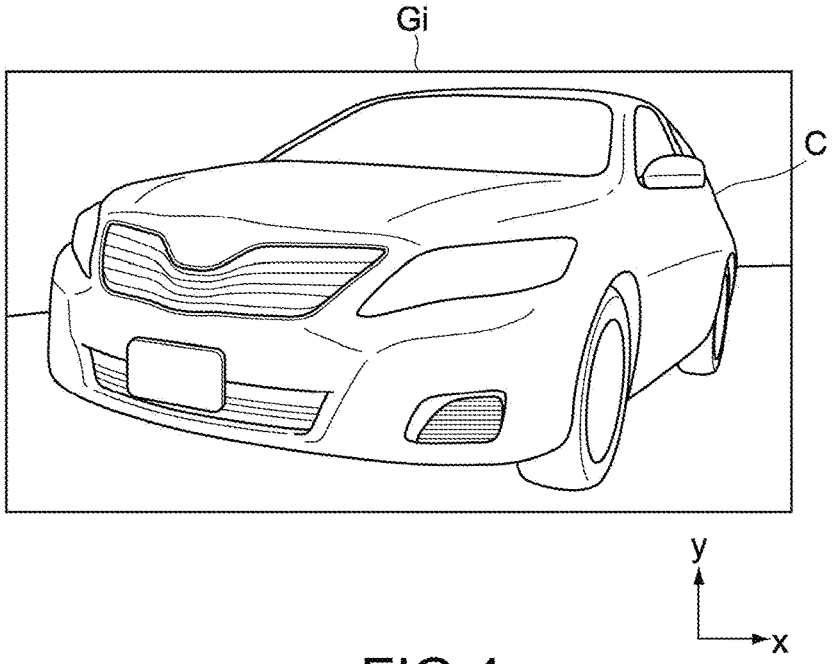
FIG. 4 A diagram showing an example of an input image used in processing of the image processing apparatus.

FIG. 4 is a diagram showing an example of an input image Gi. Here, the processing is carried out with the object being a vehicle C. It should be noted that the x-axis direction in the figure indicates a width direction (horizontal direction), and the y-axis direction indicates a height direction (longitudinal direction) orthogonal to the x-axis direction.

Subsequently, the image information analysis unit 102 analyzes information of the input image including information on the vehicle (object) C (ST32). As the analysis of the information on an object, for example, the image information analysis unit 102 can detect an object area, predict an object type, analyze an actual size of the object, and the like. The image information analysis unit 102 also analyzes a specification of the input image such as a resolution (pixel count) of the input image.

Next, the display area specification acquisition unit 103 acquires the specification of the display area 16*a* which includes, for example, the size of the display area 16*a*, a resolution (pixel count) of the display area 16*a*, a pixel pitch, and a distance between the lower side of the display area 16*a* and the first base surface B1 (ST33).

Figure 5:
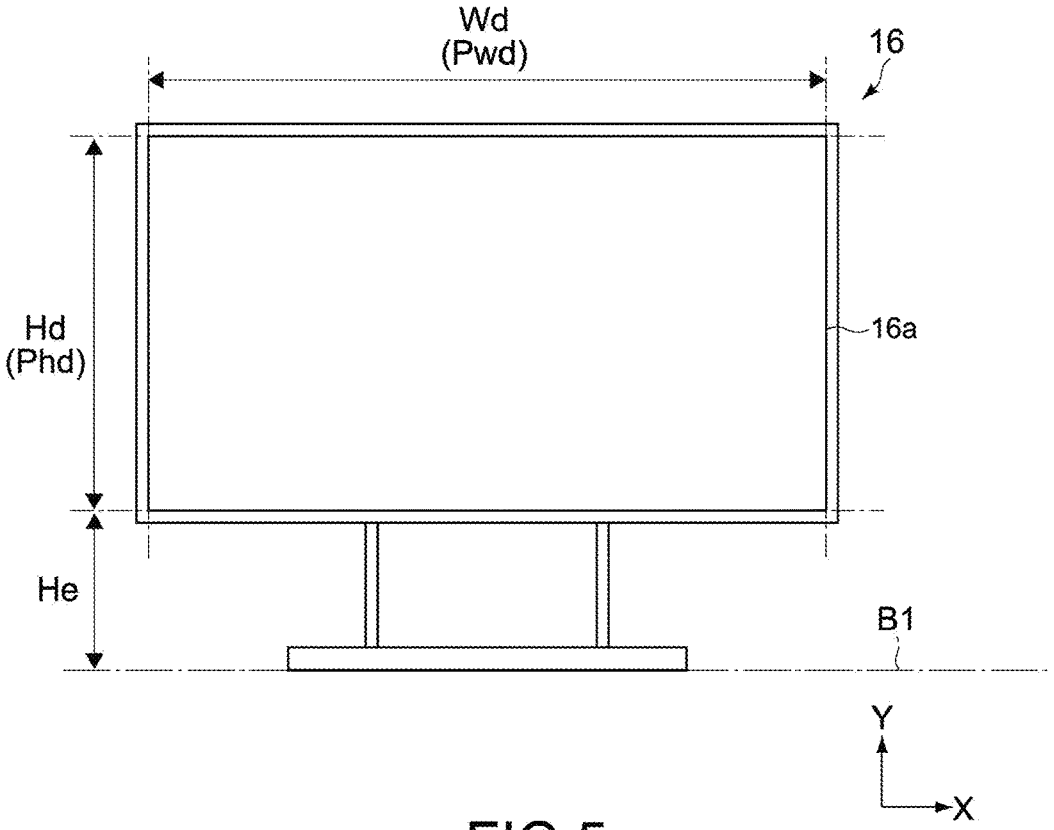
FIG. 5 A diagram showing an example of a display area of the image processing apparatus.

FIG. 5 is a diagram showing an example of the display area 16*a*. For example, the width and height of the display area 16*a* are respectively indicated by Wd (mm) and Hd (mm) and can respectively be expressed as Pwd (pixel) and Phd (pixel) in pixel count. In addition, the distance between the lower side of the display area 16*a* and the first base surface B1 (height) can be expressed as He (mm). It should be noted that the symbol B1 in the figure is a line indicating the first base surface. Moreover, the X-axis direction indicates a width direction (horizontal direction), and the Y-axis direction indicates a height direction (longitudinal direction) orthogonal to the X-axis direction.

Subsequently, the image size adjustment unit 104 adjusts the size of the input image Gi so that the vehicle C of the input image Gi is displayed in full size from the display area 16*a* (ST34).

Figure 6:
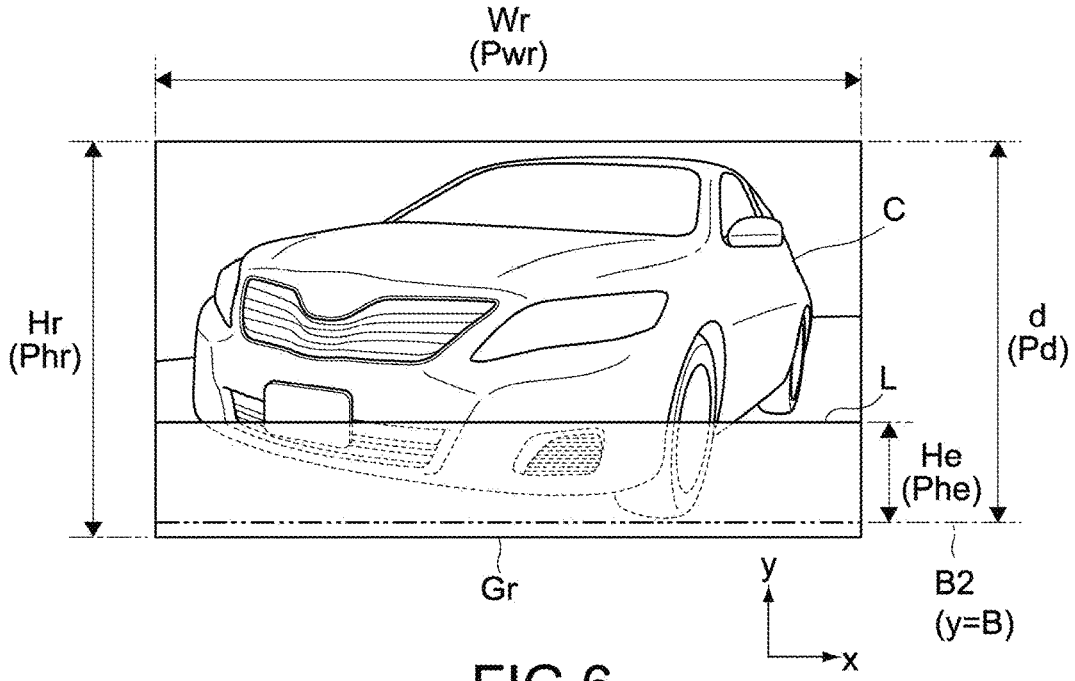
FIG. 6 A diagram showing an example of a full-size image used in the processing of the image processing apparatus.

FIG. 6 is a diagram showing an example of a full-size image Gr. The image size adjustment unit 104 determines, on the basis of information on a pixel pitch pp (mm/pixel) of the display area 16*a*, the pixel counts of the width (Pwr (pixel)) and height (Phr (pixel)) of the full-size image Gr so that the object C is displayed in full size. The pixel pitch can be calculated on the basis of the resolution of the display 16 (display area 16*a*), which is a value unique to the display 16, and the size of the display area 16*a*. In FIG. 6, when the width and height of the full-size image Gr are respectively expressed as Wr (mm) and Hr (mm) and respectively expressed as Pwr (pixel) and Phr (pixel) in pixel count, the following expressions (1) and (2) are established.

$$Wr(mm)=Pwr(pixel)*pp(mm/pixel) \quad (1)$$

$$Hr(mm)=Phr(pixel)*pp(mm/pixel) \quad (2)$$

Next, on the basis of the positional relationship between the first base surface B1 of the space where the display area 16*a* exists and the display area 16*a*, the display position determination unit 105 determines the display position of the full-size image obtained by adjusting the size of the input image, in the display area 16*a* (ST35).

In the same step ST35 shown in FIG. 6, the second base surface information acquisition unit 105*a* first acquires information on the position of the second base surface B2 in the space where the object C exists from the full-size image Gr and detects a coordinate position of the second base surface in the input image (ST35-1). In the example shown in the figure, for example, a line where one of the front wheels of the object C is positioned can be detected as the position of the second base surface B2. The second base surface information acquisition unit 105*a* can detect the coordinate position of the second base surface B2 as a straight line parallel to a lower side of the full-size image Gr. In the example shown in the figure, the second base surface B2 is expressed by y=B (B is a constant).

Next, the display position determination unit 105 determines the display position while enabling the position of the first base surface to match that of the second base surface B2 in the full-size image (ST35-2). In this operation example, a line L shown in FIG. 6 that is He (mm) higher than the second base surface B2 is detected, and this line L is caused to match with the lower side of the display area 16*a*. As a result, it becomes possible to cause the position of the first base surface B1 to match that of the second base surface B2. Specifically, the display position is determined as follows.

Specifically, with reference to FIGS. 5 and 6, the display position determination unit 105 calculates a pixel count Phe (pixel) in the Y direction corresponding to He (mm) acquired by the display area specification acquisition unit 103. Phe (pixel) can be expressed as follows.

$$Phe(pixel)=He(mm)/pp(mm/pixel) \quad (3)$$

Accordingly, the display position determination unit 105 can detect a position of the line L that is only Phe (pixel) higher than the position of the second base surface B2 in the full-size image Gr.

Figure 7:
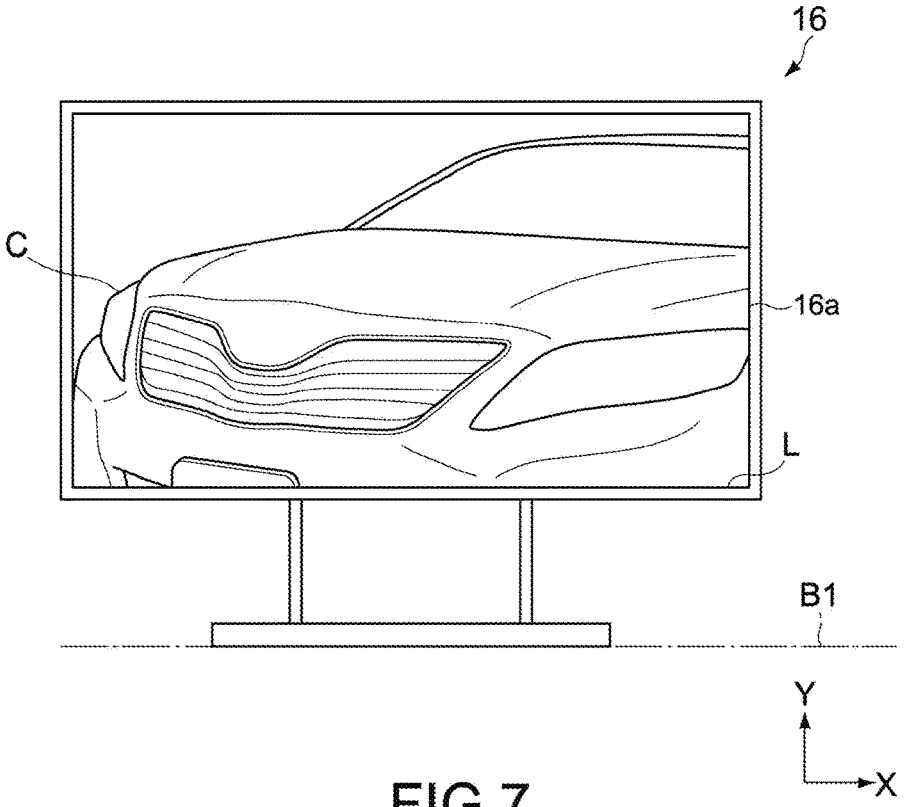
FIG. 7 A diagram showing an example of an output image output from the display area of the image processing apparatus.

Then, on the basis of the determined display position, the output image generation unit 106 generates an output image Gu including at least a part of the full-size image Gr (ST36). The output image Gu may be an image displayed such that the line L of the full-size image Gr shown in FIG. 6 matches with the lower side of the display area 16*a*. Then, as shown in FIG. 7, the output image Gu is displayed from the display area 16*a* by the reproduction unit 107.

As described above, according to this embodiment, the line of the ground surface or floor surface in the full-size image can be made to match the line of the ground surface or floor surface of the space where the display 16 including the display area 16*a* is arranged. As a result, it becomes possible to make the user feel as if the object in the full-size image is in the same space as the viewer viewing the image displayed on the display 16 and thus enhance a sense of realness. Hereinafter, operational effects of the present technology will be described in more detail with reference to the figures.

Figure 8:
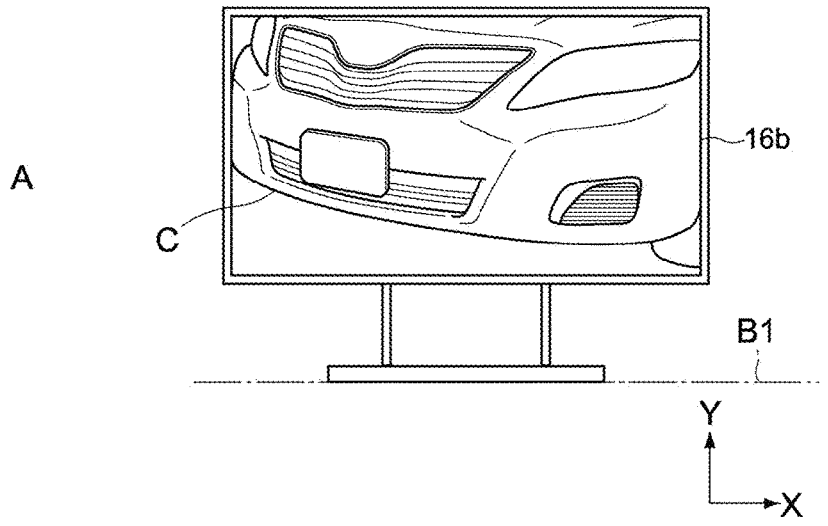
FIG. 8 Diagrams each showing an example where a full-size image is displayed irrelevant of the present technology, FIG. 8A showing a case where an object of the full-size image is larger than the display area, FIG. 8B showing a case where the object of the full-size image is smaller than the display area.
Figure 8:
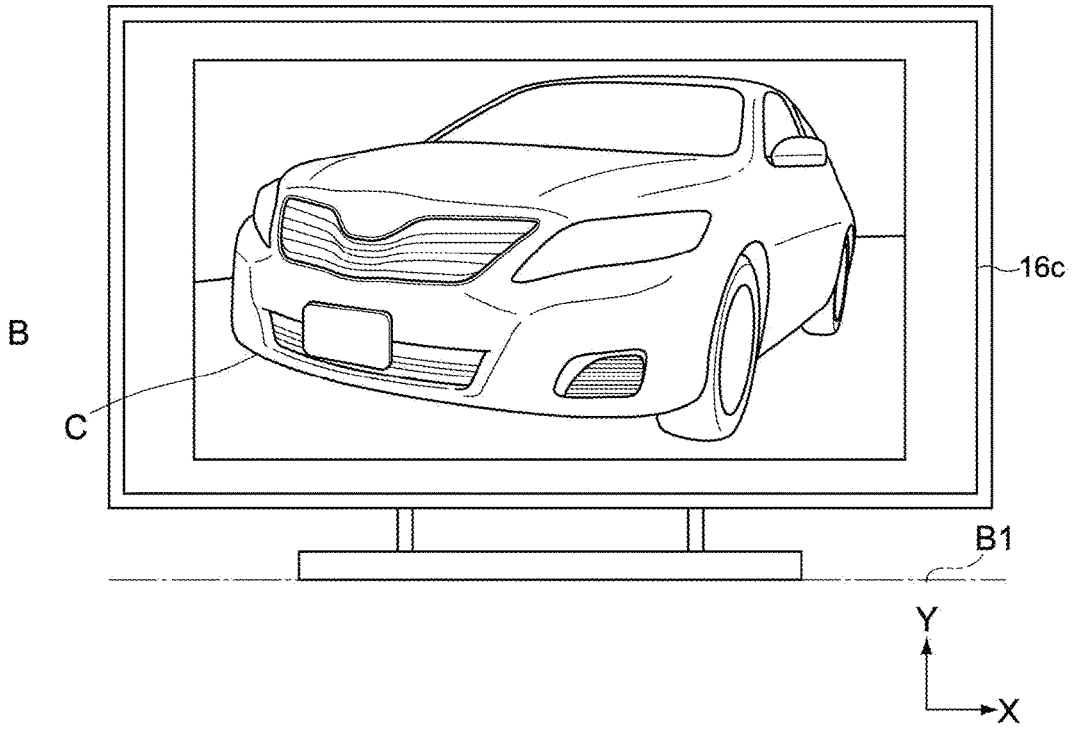

FIG. 8 are diagrams each showing an example where a full-size image is displayed irrelevant of the present technology, FIG. 8A showing a case where the object C of the full-size image is larger than a display area 16*b*, FIG. 8B showing a case where the object C of the full-size image is smaller than a display area 16*c*.

With reference to FIG. 8A, when the object C is larger than the display area 16*b*, only a part of the object C is displayed in the display area 16*b*, and thus it is considered that a gaze area that is highly frequently gazed by the user will be displayed, for example. In this regard, as shown in the figure, a front face portion of the object C may become the gaze area, for example.

However, when the user views the image shown in FIG. 8A, it feels like the object C is floating in the height direction even when the size of the object C is in full size. Consequently, a feeling that the actual thing is located in the same space as the user, that is, the sense of realness cannot be obtained. Moreover, also when the user him/herself adjusts the display position in the height direction by an input operation or the like while taking into consideration a position corresponding to the second base surface described above, it is difficult to cause that position to match with the space where the user stands.

On the other hand, referring to FIG. 8B, when the object C is smaller than the display area 16*c*, the entire full-size image is displayed in the display area 16*c*. Also in this case, it is necessary to specify which position in the display area 16*c* the full-size image is to be displayed at. In this regard, as shown in the figure, for example, there is a method of causing the center of the full-size image to match that of the display area 16*c*.

However, also when the user views the image shown in FIG. 8B, it feels like the object is floating in the height direction and lacks a sense of realness, and the adjustment of a display position is also a burden.

In contrast, according to this embodiment, it is possible to automatically adjust the position of the object C in the full-size image Gr in the height direction and cause the line of the ground surface or floor surface of the full-size image Gr to match that of the ground surface or floor surface of the space where the display 16 including the display area 16*a* is arranged as shown in FIG. 7. Therefore, it becomes possible to remove the burden of the adjustment for the user him/herself and provide an image that is closer to the real thing.

Modified Example 1-1

Figure 9:
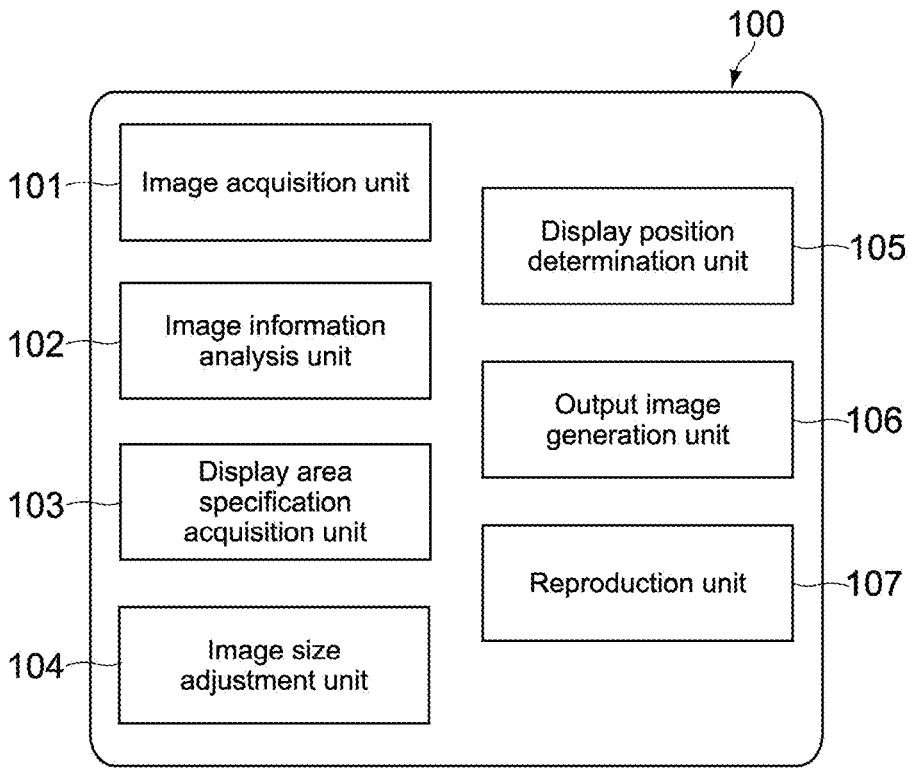
FIG. 9 A block diagram showing a functional configuration of the image processing apparatus according to a modified example 1-1.

FIG. 9 is a block diagram showing a functional configuration of the image processing apparatus 100 according to this modified example. As shown in the figure, it is also possible for the display position determination unit 105 to not include the second base surface information acquisition unit 105*a*. In this case, for example, the processing can be carried out similar to the embodiment described above assuming that a lower side of the full-size image is the second base surface. Alternatively, a configuration in which the user inputs the position of the second base surface visually checked by him/herself may be used. As a result, an image having a sense of realness can be provided while simplifying the apparatus configuration.

Modified Example 1-2

Figure 10:
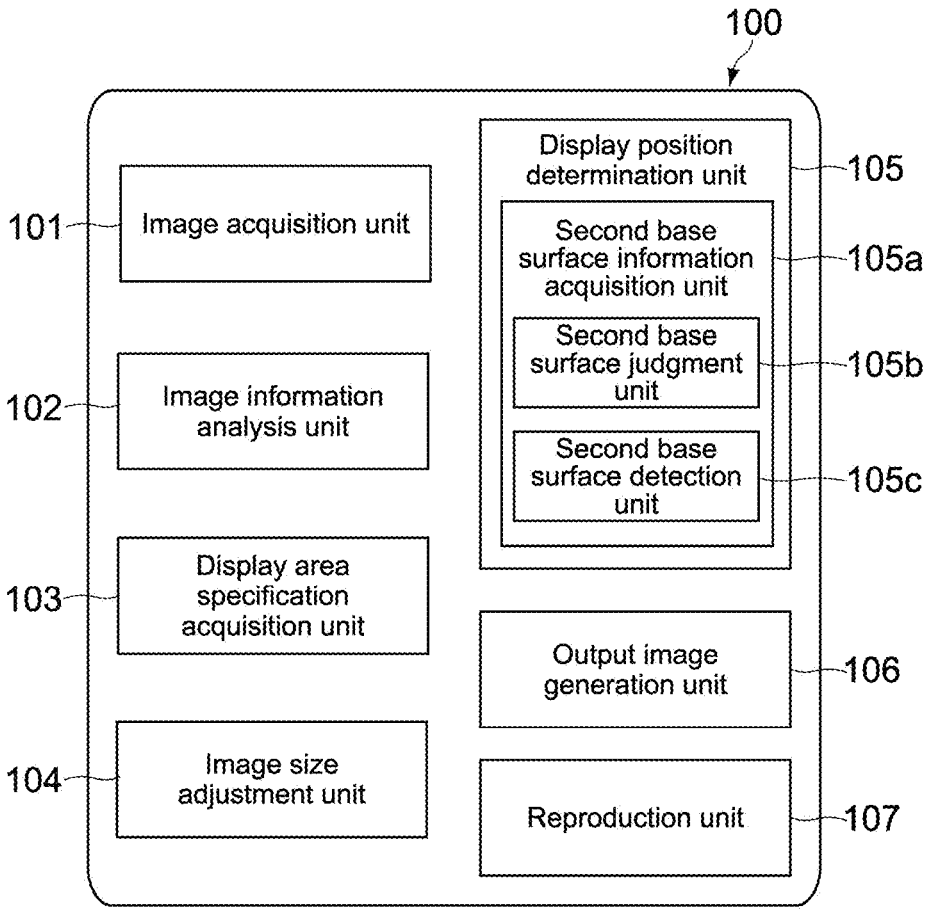
FIG. 10 A block diagram showing a functional configuration of the image processing apparatus according to a modified example 1-2.

FIG. 10 is a block diagram showing a functional configuration of the image processing apparatus 100 according to this modified example. As shown in the figure, the second base surface information acquisition unit 105*a* may include a second base surface judgment unit 105*b* and a second base surface detection unit 105*c*.

The second base surface judgment unit 105*b* judges whether the second base surface is captured in the full-size image. The judgment method is not limited in particular, and a method of detecting whether there is a tendency unique to a ground surface (or floor surface) in an image feature amount such as a contrast, color, and spatial frequency in a full-size image, a method of detecting whether an explicit horizon/horizontal line is captured in a full-size image, or the like is used. More specifically, the detection method based on the image feature amount involves judging that the second base surface is captured when detecting a brown or gray area at a lower portion of a full-size image. The method of detecting a horizon/horizontal line involves judging that the second base surface is captured when detecting a horizon/horizontal line, and assuming a portion lower than the horizon/horizontal line as a ground surface.

When judged by the second base surface judgment unit 105*b* that the second base surface is captured, the second base surface detection unit 105*c* detects a position of the second base surface from the full-size image. The detected position may be expressed two-dimensionally by using a combination of X and Y coordinates that expresses a shape of an area where the second base surface has been detected. Alternatively, the detected position may be expressed linearly using only the Y coordinates of a lowest portion out of the area where the second base surface has been detected.

Accordingly, the second base surface can be detected more accurately.

Modified Example 1-3

Figure 11:
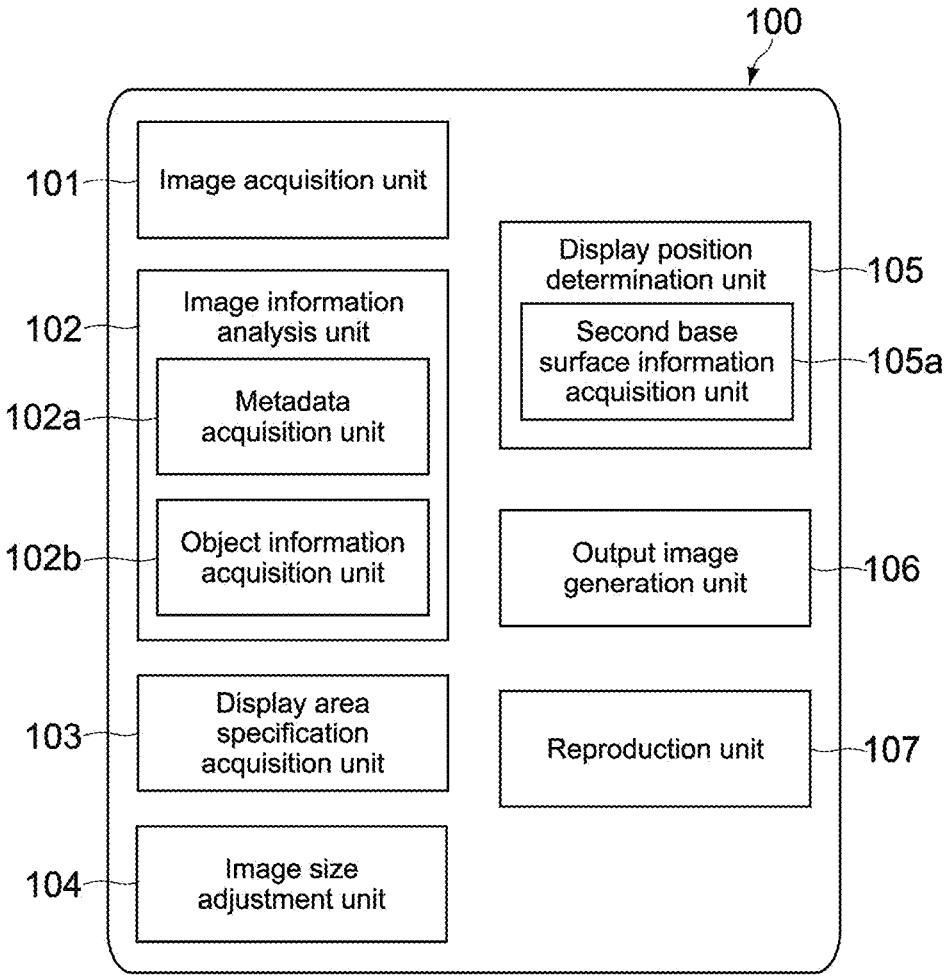
FIG. 11 A block diagram showing a functional configuration of the image processing apparatus according to a modified example 1-3.

FIG. 11 is a block diagram showing a functional configuration of the image processing apparatus 100 according to this modified example. As shown in the figure, the image information analysis unit 102 may include a metadata acquisition unit 102*a* and an object information acquisition unit 102*b*.

The metadata acquisition unit 102*a* references metadata recorded onto an input image and acquires a resolution of an image, camera parameters at a time the image was taken, positional information at the time the image was taken, and the like. An exchangeable image file format (exif) can be used as the metadata, for example. Examples of the camera parameters include a focal distance, an angle of view, and a distance between an image pickup apparatus and an object.

The object information acquisition unit 102*b* acquires information on the size of an object. The object information acquisition unit 102*b* may geometrically calculate the object size on the basis of the information on the angle of view, the distance between the image pickup apparatus and the object, and the like, or reference information on the object recorded in the metadata and the like.

Accordingly, the image size adjustment unit 104 can adjust the size of the input image on the basis of the specification of the display area 16*a*, metadata, and information on the object size. Therefore, the object size can be detected accurately, and the size adjustment of the input image can be carried out smoothly and accurately.

It should be noted that although not shown in the figure, the image information analysis unit 102 may include only the object information acquisition unit 102*b* and not the metadata acquisition unit 102*a*. In this case, the object information acquisition unit 102*b* can also acquire information on a measurement value obtained by measuring an object size at a time an image is taken. This information may be stored in the storage unit 18 in association with the input image.

Modified Example 1-4

Figure 12:
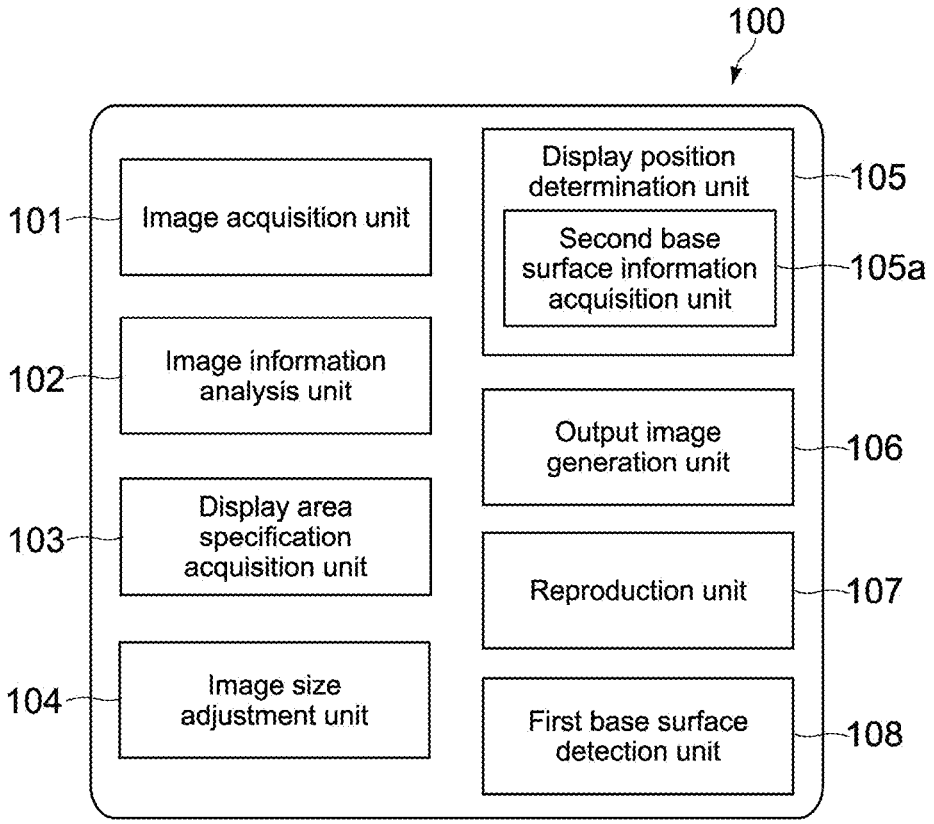
FIG. 12 A block diagram showing a functional configuration of the image processing apparatus according to a modified example 1-4.

FIG. 12 is a block diagram showing a functional configuration of the image processing apparatus 100 according to this modified example. As shown in the figure, the image processing apparatus 100 may additionally include a first base surface detection unit 108.

The first base surface detection unit 108 is capable of detecting a distance between the display area 16*a* and the first base surface, that is, He (mm) shown in FIG. 5, for example. The detection method is not limited in particular, and the distance may be measured by irradiating ultrasonic waves, laser light, or the like toward the first base surface from the vicinity of the display area 16*a*, for example. Alternatively, when a specification of a supporting tool (stand) supporting the display 16 is stored in the storage unit 18 or the like, the first base surface detection unit 108 can calculate the distance using this specification.

On the basis of the detected distance between the display area 16*a* and the first base surface, the display position determination unit 105 can determine the display position.

Accordingly, since the distance can be detected automatically, the time and effort of the user inputting the distance can be omitted.

Modified Example 1-5

Figure 13:
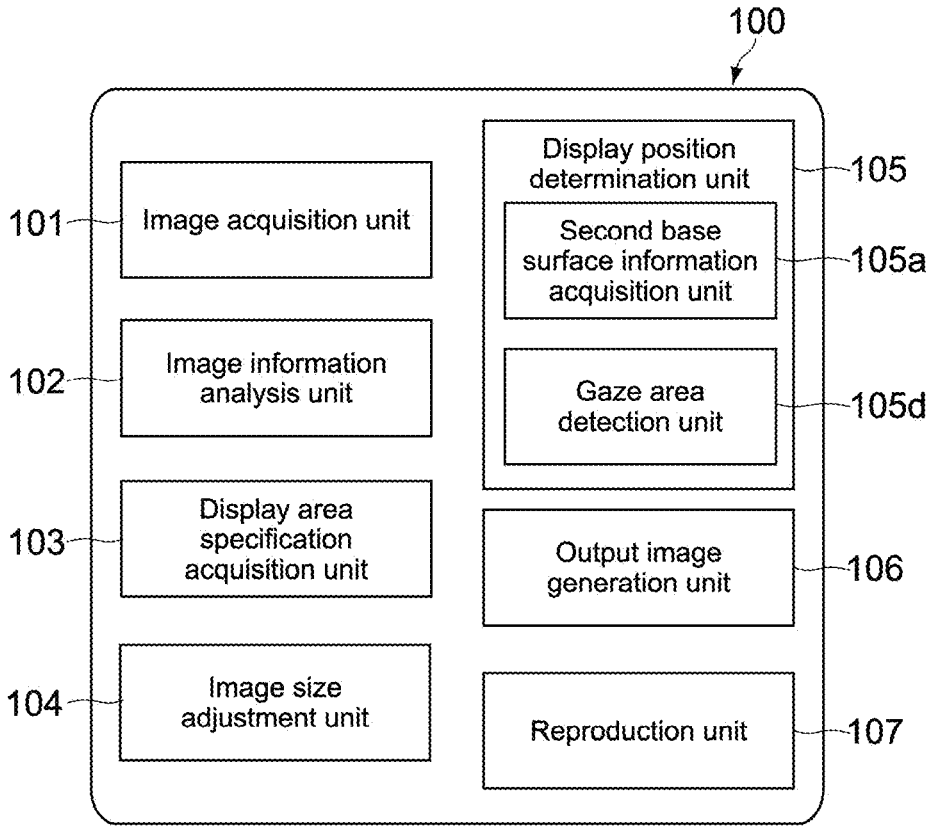
FIG. 13 A block diagram showing a functional configuration of the image processing apparatus according to a modified example 1-5.

FIG. 13 is a block diagram showing a functional configuration of the image processing apparatus 100 according to this modified example. As shown in the figure, the display position determination unit 105 may additionally include a gaze area detection unit 105*d*. Although the first embodiment above describes that the display position of a full-size image in the height direction is determined, no reference is made on the display position in the horizontal direction in particular. According to this modified example, the display position in the horizontal direction can also be determined.

The gaze area detection unit 105*d* detects an area to be gazed by the user out of the full-size image. The method of detecting a gaze area is not limited in particular. For example, it is possible to extract a characteristic object area using the image recognition technology and estimate the area as an area to be gazed by a person. For example, in the case of the full-size image Gr shown in FIG. 6, a windshield portion of the vehicle C can be detected as the gaze area.

The display position determination unit 105 can determine the display position so that the gaze area in the full-size image can be displayed from the display area 16*a*. Accordingly, an area that a user wishes to see can be displayed, and an image having a high sense of realness can be provided, thus accommodating user needs.

Modified Example 1-6

Figure 14:
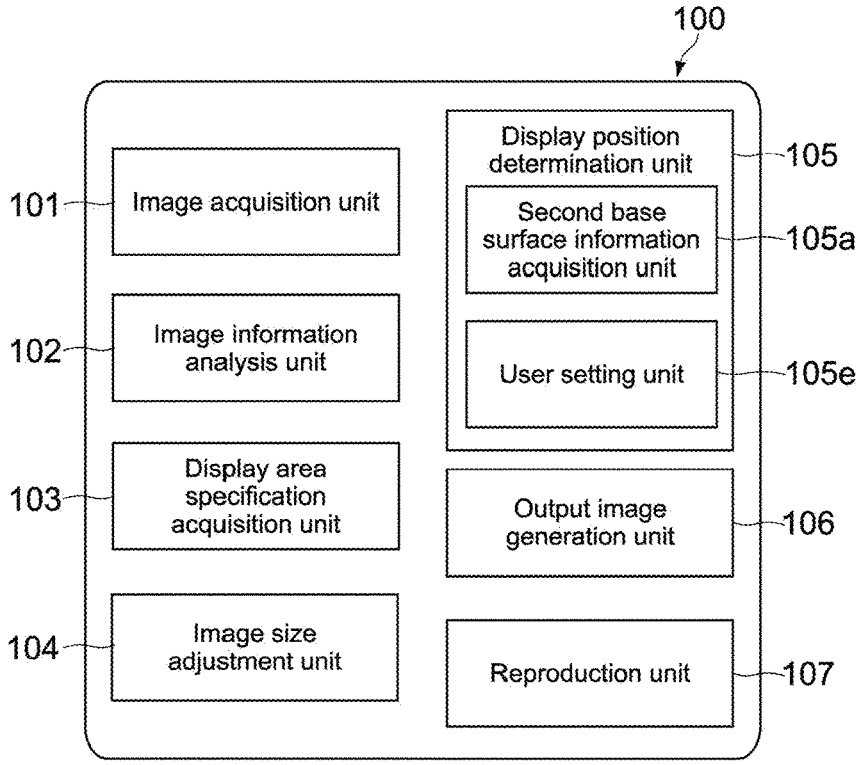
FIG. 14 A block diagram showing a functional configuration of the image processing apparatus according to a modified example 1-6.

FIG. 14 is a block diagram showing a functional configuration of the image processing apparatus 100 according to this modified example. As shown in the figure, the display position determination unit 105 may include a user setting unit 105*e*. Also by this modified example, a display position in the horizontal direction can be determined.

The user setting unit 105*e* is capable of acquiring a display position of a full-size image input by the user via the operation reception unit 17 or the like.

Accordingly, the display position determination unit 105 can adjust the display position on the basis of the input display position. Therefore, it becomes possible to reflect a user preference on the display position in a case where the user wishes to view a specific area, thus accommodating user needs.

Modified Example 1-7

Figure 15:
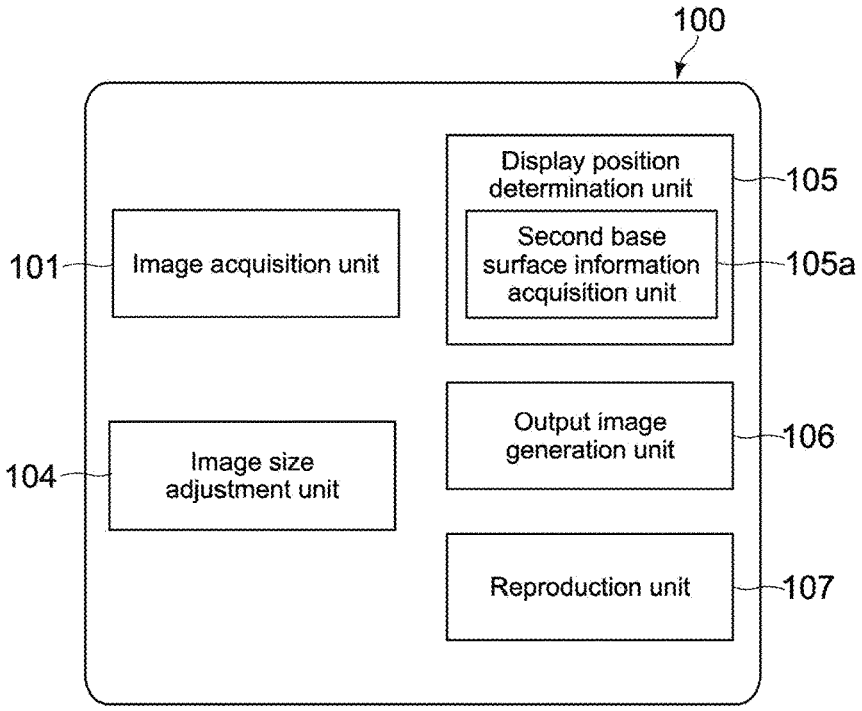
FIG. 15 A block diagram showing a functional configuration of the image processing apparatus according to a modified example 1-7.

FIG. 15 is a block diagram showing a functional configuration of the image processing apparatus 100 according to this modified example. As shown in the figure, the image processing apparatus 100 may include the image acquisition unit 101, the image size adjustment unit 104, the display position determination unit 105, the output image generation unit 106, and the reproduction unit 107 while the image information analysis unit 102 and the display area specification acquisition unit 103 are removed from the image processing apparatus 100.

In this case, the image size adjustment unit 104 can adjust the size of the input image on the basis of the object size, information of the input image, specification of the display area 16*a*, and the like that have been input by the user via the operation reception unit 17 or the like. Also by this modified example, an image having a high sense of realness can be provided.

Modified Example 1-8

In the first embodiment above, the image size adjustment unit 104 enlarges or reduces an input image to generate a full-size image, but the present technology is not limited thereto. For example, the image size adjustment unit 104 may calculate an enlargement factor or reduction ratio without generating a full-size image itself. In this case, the display position determination unit 105 can determine the display position while assuming the full-size image on the basis of the enlargement factor or reduction ratio, and the output image generation unit 106 can generate an output image from the input image on the basis of the enlargement factor or reduction ratio and the determined display position. Therefore, processing similar to that described above can be carried out.

Further, in this modified example, the second base surface information acquisition unit 105*a* is capable of acquiring information on a position of a second base surface of a space where an object exists from the input image and acquire information on the position of the second base surface in the full-size image while considering the enlargement factor or reduction ratio. Further, when the second base surface information acquisition unit 105*a* includes the second base surface judgment unit 105*b*, by the second base surface judgment unit 105*b* judging whether the second base surface is captured in the input image, it is possible to judge whether the second base surface is captured in the full-size image. Also for the second base surface detection unit 105*c*, when judged that the second base surface is captured in the full-size image, it is possible to detect the position of the second base surface from the input image and calculate the position of the second base surface in the full-size image.

Modified Example 1-9

The first embodiment above takes the case where there is one object as the example, but there may be a plurality of objects. For example, when there are a plurality of detected objects, the image information analysis unit 102 may focus on the object occupying most areas or focus on the object predicted to be in the very front (position having smallest depth).

Modified Example 1-10

In the first embodiment above, the display position determination unit 105 uses information stored in advance as the specification of the display area 16*a* to acquire information on the distance between the first base surface and the display area 16*a*, but the present technology is not limited thereto. For example, the display position determination unit 105 can use information on the distance between the display area 16*a* and the first base surface, that has been predicted and input by the user.

Moreover, although the distance between the display area 16*a* and the first base surface is described as the distance between the lower side of the display area 16*a* and the first base surface, in a case where the size of the display area 16*a* is known, the distance between the lower side of the display area 16*a* and the first base surface may be calculated on the basis of a distance between an upper side of the display area 16*a* and the first base surface, a distance between the center of the display area 16*a* and the first base surface, or the like.

Modified Example 1-11

In the first embodiment above, the input image is described as a still image, but the input image may be a moving image. In this case, the processing described above may be carried out for each frame of the moving image so as to adjust the display position. Alternatively, when it is assumed that the second base surface does not largely vary among the plurality of consecutive frames, the processing described above may be carried out for the first frame, and the rest of the frames may be reproduced consecutively at the same display position as the first frame. Moreover, when it is detected that the image feature amount or the like largely varies among the plurality of consecutive frames, for example, and that the object is varying, the processing described above may be carried out on only the frames having large variances.

Second Embodiment (Hardware Configuration of Image Processing Apparatus)

Figure 16:
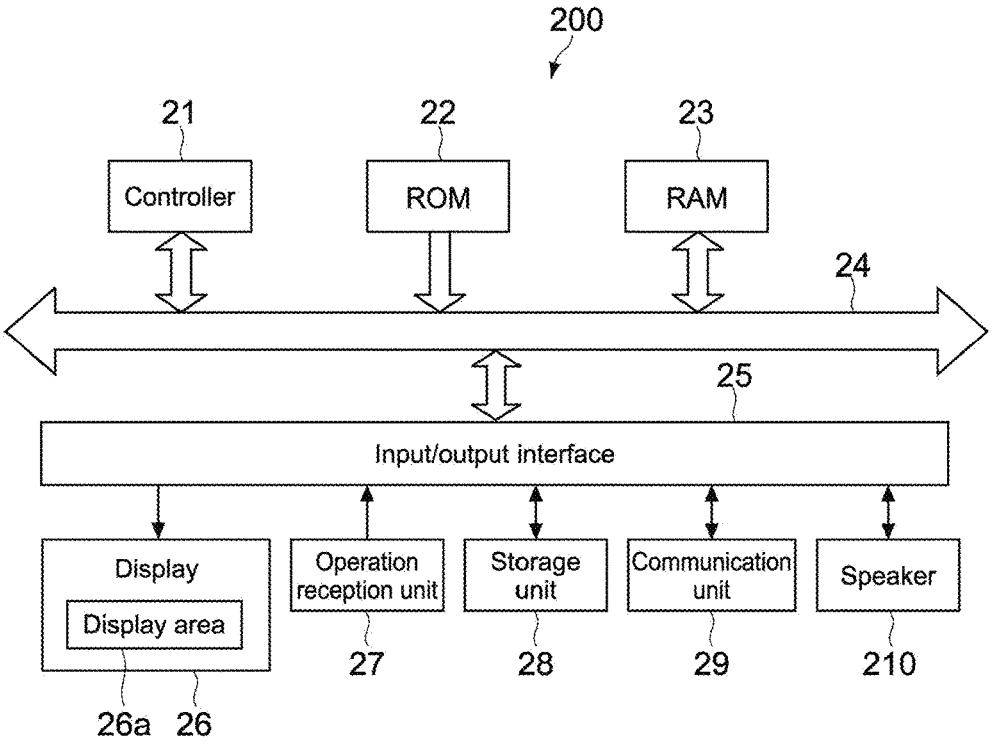
FIG. 16 A block diagram showing a hardware configuration of an image processing apparatus according to a second embodiment of the present technology.

FIG. 16 is a block diagram showing a hardware configuration of an image processing apparatus 200 according to a second embodiment of the present technology. As in the first embodiment, the image processing apparatus 200 may be configured as an information processing apparatus. Specifically, the image processing apparatus 200 may be an information processing apparatus such as a PC, a tablet PC, a smartphone, and a tablet terminal. It should be noted that in the descriptions below, configurations similar to those of the first embodiment are denoted by the same symbols, and descriptions thereof will be omitted.

In addition to the configuration of the image processing apparatus 100, the image processing apparatus 200 is further capable of determining a position of outputting audio associated with an input image according to a display position.

Specifically, the image processing apparatus 200 includes a controller 21, a ROM 22, a RAM 23, an input/output interface 25, and a bus 24 mutually connecting them. Further, in addition to an operation reception unit 27, a storage unit 28, and a communication unit 29, a speaker 210 is connected to the input/output interface 25. Since the controller 21, the ROM 22, the RAM 23, the bus 24, the input/output interface 25, the display 26, the operation reception unit 27, the storage unit 28, and the communication unit 29 have configurations similar to those of the controller 11, the ROM 12, the RAM 13, the bus 14, the input/output interface 15, the operation reception unit 17, the storage unit 18, and the communication unit 19, descriptions thereof will be omitted. It should be noted that a display area 26*a* similar to the display area 16*a* is demarcated on the display 26.

The speaker 210 is capable of outputting audio. For example, the speaker 210 may include a plurality of small speakers arranged inside the display 26. The small speakers may be arranged for each pixel or each predetermined unit area including a plurality of pixels. The speaker 210 may also be a single speaker capable of moving on a back surface or circumference of the display 26, for example. In this case, the speaker 210 may include a speaker body and a movement mechanism.

(Functional Configuration of Image Processing Apparatus)

Figure 17:
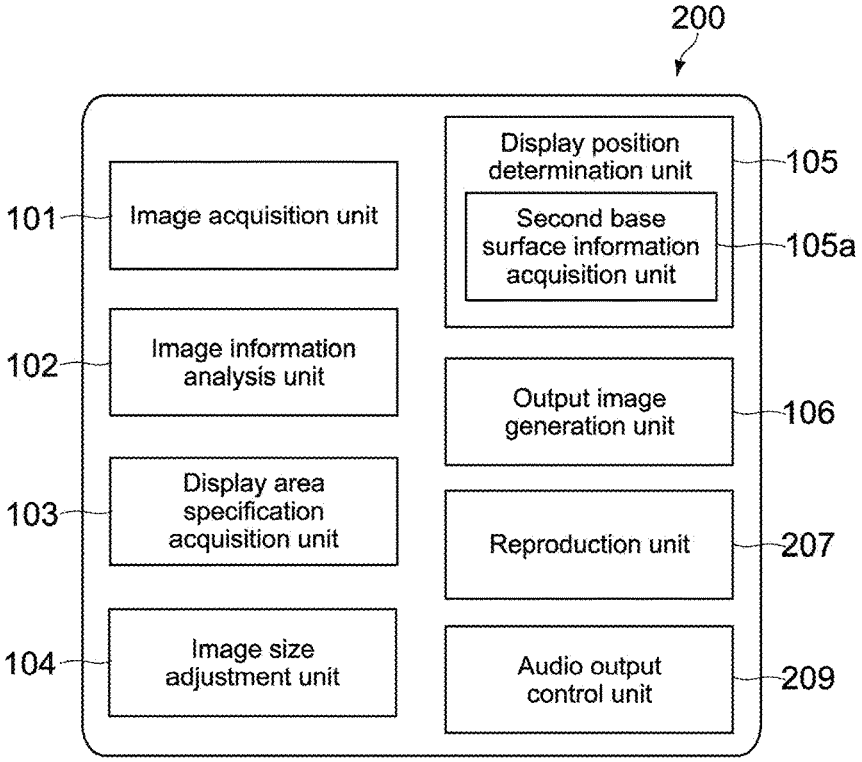
FIG. 17 A block diagram showing a functional configuration of the image processing apparatus.

FIG. 17 is a block diagram showing a functional configuration of the image processing apparatus 2. As shown in the figure, the image processing apparatus 2 includes the image acquisition unit 101, the image information analysis unit 102, the display area specification acquisition unit 103, the image size adjustment unit 104, the display position determination unit 105, the output image generation unit 106, a reproduction unit 207, and an audio output control unit 209.

The audio output control unit 209 controls an output position of audio associated with a full-size image, on the basis of the determined display position. The audio output control unit 209 is realized by the controller 21, for example. Specifically, when there is an area in an object of the full-size image (input image) from which the audio is predicted to be output, the audio output control unit 209 controls the speaker 210 such that the audio is output from the vicinity of the area whose display position has been adjusted. More specifically, when the object of the full-size image is a vehicle (see FIG. 6 etc.), the audio output control unit 209 can control the speaker 210 such that the audio of an engine sound of the vehicle associated with the full-size image is output from the vicinity of a front portion of the vehicle whose display position has been determined. It should be noted that the "audio associated with the full-size image" is typically audio recorded at a time the input image is taken, but it may alternatively be audio predicted to be emitted from the object in the input image.

When the speaker 210 is arranged inside the display 26, for example, the audio output control unit 209 controls the speaker 210 such that the audio is output from pixels corresponding to the area from which the audio is predicted to be output or small speakers arranged in unit areas. Alternatively, when the speaker 210 is movable, the audio output control unit 209 moves the speaker 210 to a position close to the area from which the audio is predicted to be output and controls the speaker 210 to output the audio.

The reproduction unit 207 displays an output image and also outputs the controlled audio. The reproduction unit 207 is realized by the display 26 and the speaker 210, for example.

According to this embodiment, the line of the ground surface or floor surface in the full-size image can be made to match that of the ground surface or floor surface of the space where the display 26 including the display area 26*a* is arranged, and the audio that may be emitted from the object of the full-size image can be emitted from the vicinity of the object whose display position has been adjusted. As a result, the object in the full-size image can be felt like it is in the same space as a viewer viewing the image on the display 26, and thus vividness and a sense of realness can be additionally enhanced.

Third Embodiment (Schematic Configuration of Image Processing System)

Figure 18:
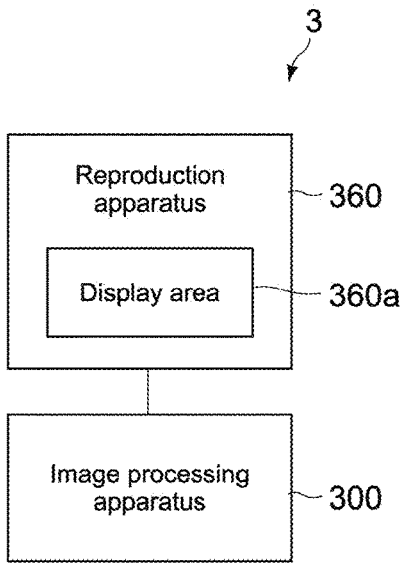
FIG. 18 A block diagram showing a schematic configuration of an image processing apparatus according to a third embodiment of the present technology.

FIG. 18 is a block diagram showing a schematic configuration of an image processing system 3 according to a third embodiment of the present technology. In the figure, the image processing system 3 includes an image processing apparatus 300 and a reproduction apparatus 360. The image processing apparatus 300 and the reproduction apparatus 360 are mutually connected by wires or wirelessly. The reproduction apparatus 360 is configured as an apparatus capable of displaying images, such as a display apparatus, a projector apparatus, a wearable terminal, a PC, a tablet PC, a smartphone, and a tablet terminal, and includes a display area 360*a*. The image processing apparatus 300 may be configured as an information processing apparatus such as a PC, a tablet PC, a smartphone, and a tablet terminal. It should be noted that the hardware configuration of the image processing apparatus 300 is similar to that of the image processing apparatus 100, so descriptions thereof will be omitted.

The image processing system 3 is capable of performing operations as follows. Specifically, using an input image and a specification of the display area transmitted from the reproduction apparatus 360, the image processing apparatus 300 analyzes image information, adjusts a size of the input image, and adjusts a display position to thus generate an output image. Then, the image processing apparatus 300 transmits the generated output image to the reproduction apparatus 360, and the reproduction apparatus 360 displays the output image obtained by these operations.

(Functional Configuration of Image Processing System)

Figure 19:
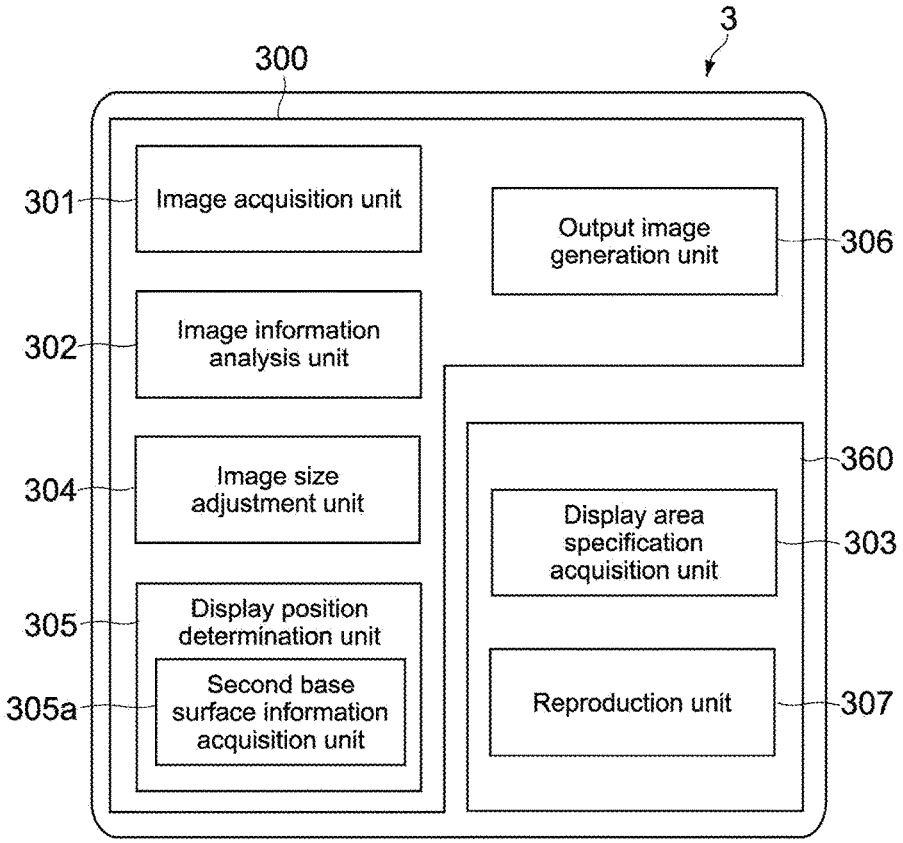
FIG. 19 A block diagram showing a functional configuration of the image processing apparatus.

FIG. 19 is a block diagram showing a functional configuration of the image processing system 3. As shown in the figure, the image processing system 3 includes an image acquisition unit 301, an image information analysis unit 302, a display area specification acquisition unit 303, an image size adjustment unit 304, a display position determination unit 305, an output image generation unit 306, and a reproduction unit 307. Of those, the image processing apparatus 300 includes the image acquisition unit 301, the image information analysis unit 302, the image size adjustment unit 304, the display position determination unit 305, and the output image generation unit 306. The reproduction apparatus 360 includes the display area specification acquisition unit 303 and the reproduction unit 307.

The elements described above respectively have configurations similar to those of the image acquisition unit 101, the image information analysis unit 102, the display area specification acquisition unit 103, the image size adjustment unit 104, the display position determination unit 105, the output image generation unit 106, and the reproduction unit 107 of the image processing apparatus 100. In other words, the image acquisition unit 301 acquires an input image to be processed.

The image information analysis unit 302 analyzes information of the input image including information on an object. The display area specification acquisition unit 303 acquires a specification of the display area 360*a*. The image size adjustment unit 304 adjusts a size of the input image so that the object of the input image is displayed in full size from the display area 360*a*. The display position determination unit 305 determines, on the basis of a positional relationship between a first base surface of a space where the display area exists and the display area 360*a*, a display position of a full-size image obtained by adjusting the size of the input image in the display area 360*a*. The output image generation unit 306 generates an output image including at least a part of the full-size image on the basis of the determined display position. The reproduction unit 307 reproduces the output image from the display area 360*a*.

The reproduction apparatus 360 is capable of transmitting the input image and the information on the specification of the display area 360*a* that has been acquired by the display area specification acquisition unit 303 to the image processing apparatus 300. The image processing apparatus 300 stores the input image and the information on the specification of the display area 360*a* in a storage unit 38 or the like to use them for the processing.

The image processing apparatus 300 transmits the output image generated by the output image generation unit 306 to the reproduction apparatus 360. Accordingly, the reproduction unit 307 of the reproduction apparatus 360 can display the output image from the display area 360*a*.

Even the image processing apparatus 300 having the configuration as described above can make the user feel as if the object in the full-size image is in the same space as the viewer viewing the image displayed on the reproduction apparatus 360 and feel that the object is closer to the real thing, similar to the image processing apparatus 100.

Modified Example 3-1

The image processing system 3 is a cloud system like an image processing system 5 to be described later, and the image processing apparatus 300 and the reproduction apparatus 360 may be mutually connected via a network. In this case, the image processing apparatus 300 is configured as a server apparatus (information processing apparatus), and the reproduction apparatus 360 is configured as a user terminal such as a PC, a tablet PC, a smartphone, and a tablet terminal.

Fourth Embodiment (Schematic Configuration of Image Processing System)

Figure 20:
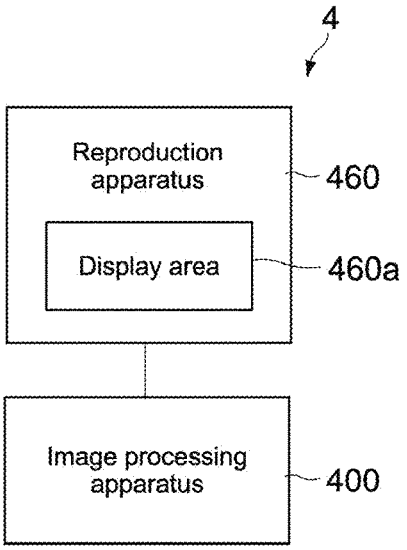
FIG. 20 A block diagram showing a schematic configuration of an image processing apparatus according to a fourth embodiment of the present technology.

FIG. 20 is a block diagram showing a schematic configuration of an image processing system 4 according to a fourth embodiment of the present technology. In the figure, the image processing system 4 includes an image processing apparatus 400 and a reproduction apparatus 460. The image processing apparatus 400 and the reproduction apparatus 460 are mutually connected by wires or wirelessly. The reproduction apparatus 460 is configured as an apparatus capable of displaying images, such as a display apparatus, a projector apparatus, a wearable terminal, a PC, a tablet PC, a smartphone, and a tablet terminal, and includes a display area 460*a*. The image processing apparatus 400 may be configured as an information processing apparatus such as a PC, a tablet PC, a smartphone, and a tablet terminal. It should be noted that the hardware configuration of the image processing apparatus 400 is similar to that of the image processing apparatus 100, so descriptions thereof will be omitted.

The image processing system 4 is capable of performing operations as follows. Specifically, using an input image and a specification of the display area 460*a* transmitted from the reproduction apparatus 460, the image processing apparatus 400 analyzes image information, adjusts a size of the input image, and adjusts a display position. Then, the image processing apparatus 400 transmits a full-size image, the adjusted display position, and the like to the reproduction apparatus 460, and the reproduction apparatus 460 generates and displays an output image on the basis of these operations.

(Functional Configuration of Image Processing System)

Figure 21:
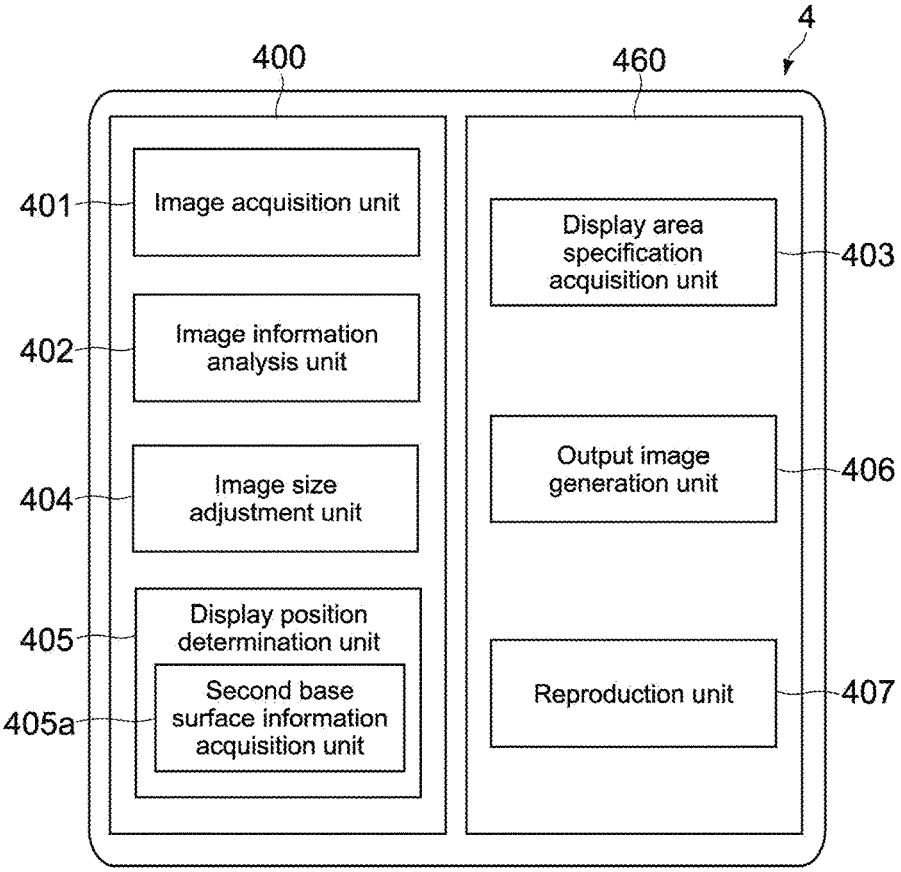
FIG. 21 A block diagram showing a functional configuration of the image processing apparatus.

FIG. 21 is a block diagram showing a functional configuration of the image processing system 4. As shown in the figure, the image processing system 4 includes an image acquisition unit 401, an image information analysis unit 402, a display area specification acquisition unit 403, an image size adjustment unit 404, a display position determination unit 405, an output image generation unit 406, and a reproduction unit 407. Of those, the image processing apparatus 400 includes the image acquisition unit 401, the image information analysis unit 402, the image size adjustment unit 404, and the display position determination unit 405. The reproduction apparatus 460 includes the display area specification acquisition unit 403, the output image generation unit 406, and the reproduction unit 407.

The elements described above respectively have configurations similar to those of the image acquisition unit 101, the image information analysis unit 102, the display area specification acquisition unit 103, the image size adjustment unit 104, the display position determination unit 105, the output image generation unit 106, and the reproduction unit 107 of the image processing apparatus 100. In other words, the image acquisition unit 401 acquires an input image to be processed. The image information analysis unit 402 analyzes information of the input image including information on an object. The display area specification acquisition unit 403 acquires a specification of the display area 460*a*. The image size adjustment unit 404 adjusts a size of the input image so that the object of the input image is displayed in full size from the display area 460*a*. The display position determination unit 405 determines, on the basis of a positional relationship between a first base surface of a space where the display area 460*a* exists and the display area 460*a*, a display position of a full-size image obtained by adjusting the size of the input image in the display area 460*a*. The output image generation unit 406 generates an output image including at least a part of the full-size image on the basis of the determined display position. The reproduction unit 407 reproduces the output image from the display area 460*a*.

The reproduction apparatus 460 is capable of transmitting the input image and the information on the specification of the display area 460*a* that has been acquired by the display area specification acquisition unit 403 to the image processing apparatus 400. The image processing apparatus 400 stores the input image and the information on the specification of the display area 460*a* to use them for the processing.

The image processing apparatus 400 transmits a full-size image and information on the display position determined by the display position determination unit 405 to the reproduction apparatus 460. Accordingly, the output image generation unit 406 of the reproduction apparatus 460 generates an output image on the basis of the full-size image and the information on the display position so that the reproduction unit 407 can display the output image from the display area 460*a*.

Even the image processing apparatus 400 having the configuration as described above can make the user feel as if the object in the full-size image is in the same space as the viewer viewing the image displayed on the reproduction apparatus 460 and feel that the object is closer to the real thing, similar to the image processing apparatus 100.

Modified Example 4-1

The image processing apparatus 400 is not limited to the configuration of transmitting a full-size image and information on a display position, and a configuration in which information on an enlargement factor or reduction ratio of an input image and information on a display position are transmitted may be adopted, for example. Also with this configuration, the output image generation unit 406 of the reproduction apparatus 460 can generate an output image.

Modified Example 4-2

The image processing system 4 is a cloud system like an image processing system 5 to be described later, and the image processing apparatus 400 and the reproduction apparatus 460 may be mutually connected via a network. In this case, the image processing apparatus 400 is configured as a server apparatus (information processing apparatus), and the reproduction apparatus 360 is configured as a user terminal such as a PC, a tablet PC, a smartphone, and a tablet terminal.

Fifth Embodiment (Schematic Configuration of Image Processing System)

Figure 22:
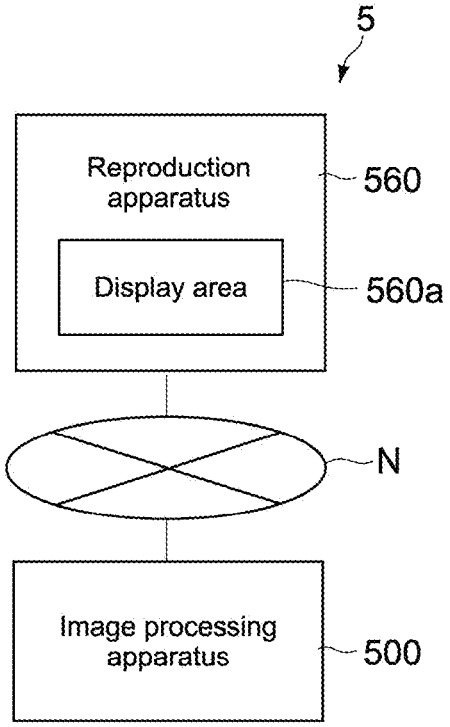
FIG. 22 A block diagram showing a schematic configuration of an image processing apparatus according to a fifth embodiment of the present technology.

FIG. 22 is a block diagram showing a schematic configuration of the image processing system 5 according to a fifth embodiment of the present technology. In the figure, the image processing system 5 is a cloud system and includes an image processing apparatus 500 and a reproduction apparatus 560. The image processing apparatus 500 and the reproduction apparatus 560 are mutually connected via a network N. The reproduction apparatus 560 is configured as a user terminal and includes a display area 560*a*. The image processing apparatus 500 is configured as a server apparatus (information processing apparatus) on the network N, for example. It should be noted that the hardware configurations of the image processing apparatus 500 and the reproduction apparatus 560 are similar to that of the image processing apparatus 100, so descriptions thereof will be omitted.

The image processing system 5 is capable of performing operations as follows. Specifically, the reproduction apparatus 560 analyzes an input image, acquires a specification of a display area, and the like and transmits those pieces of information to the image processing apparatus 500. Then, on the basis of those pieces of information, the image processing apparatus 500 adjusts a size of the input image and a display position to generate an output image. After that, the image processing apparatus 500 transmits the generated output image to the reproduction apparatus 560, and the reproduction apparatus 560 displays the output image generated by these operations.

(Functional Configuration of Image Processing System)

Figure 23:
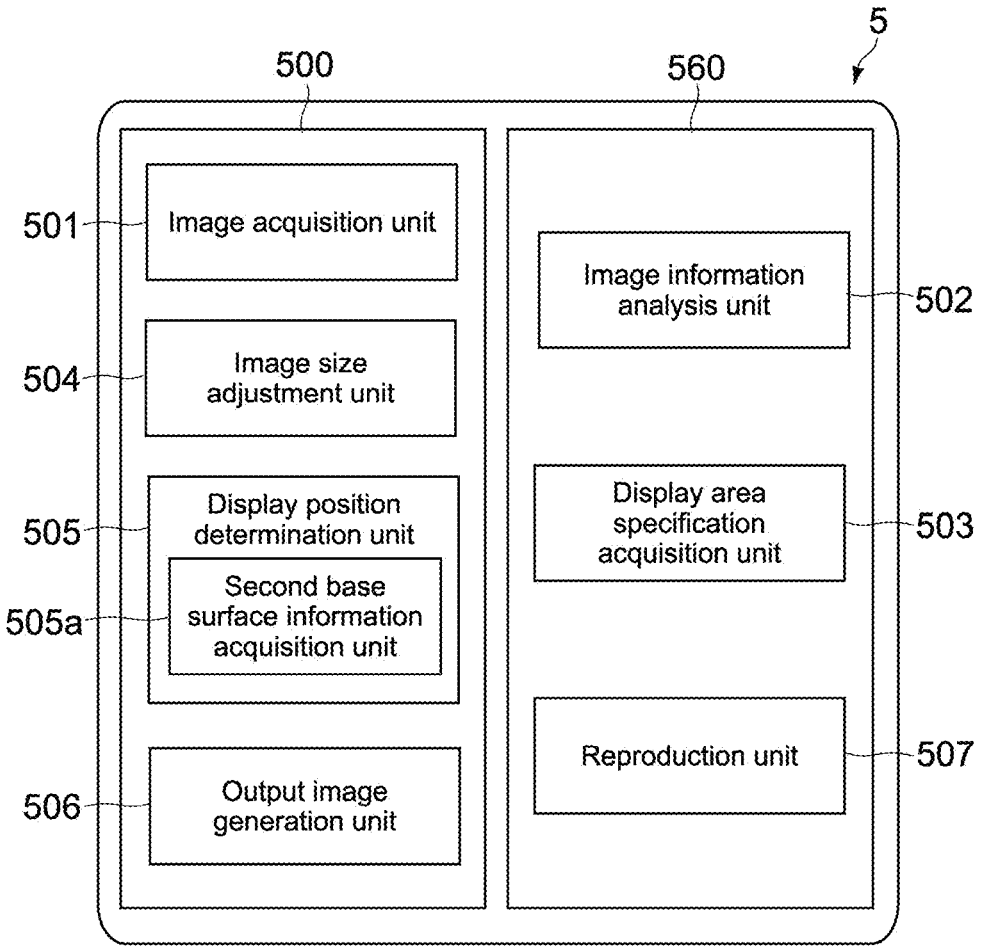
FIG. 23 A block diagram showing a functional configuration of the image processing apparatus.

FIG. 23 is a block diagram showing a functional configuration of the image processing system 5. As shown in the figure, the image processing system 5 includes an image acquisition unit 501, an image information analysis unit 502, a display area specification acquisition unit 503, an image size adjustment unit 504, a display position determination unit 505, an output image generation unit 506, and a reproduction unit 507. Of those, the image processing apparatus 500 includes the image acquisition unit 501, the image size adjustment unit 504, the display position determination unit 505, and the output image generation unit 506. The reproduction apparatus 560 includes the image information analysis unit 502, the display area specification acquisition unit 503, and the reproduction unit 507.

The elements described above respectively have configurations similar to those of the image acquisition unit 101, the image information analysis unit 102, the display area specification acquisition unit 103, the image size adjustment unit 104, the display position determination unit 105, the output image generation unit 106, and the reproduction unit 107 of the image processing apparatus 100. In other words, the image acquisition unit 501 acquires an input image to be processed. The image information analysis unit 502 analyzes information of the input image including information on an object. The display area specification acquisition unit 503 acquires a specification of the display area 560*a*. The image size adjustment unit 504 adjusts a size of the input image so that the object of the input image is displayed in full size from the display area 560*a*. The display position determination unit 505 determines, on the basis of a positional relationship between a first base surface of a space where the display area 560*a* exists and the display area 560*a*, a display position of a full-size image obtained by adjusting the size of the input image in the display area 560*a*. The output image generation unit 506 generates an output image including at least a part of the full-size image on the basis of the determined display area 560*a*. The reproduction unit 507 displays at least a part of the full-size image whose display position has been determined as the output image.

The reproduction apparatus 560 transmits the information of the input image analyzed by the image information analysis unit 502 and the specification of the display area 560*a* acquired by the display area specification acquisition unit 503 to the image processing apparatus 500 together with the input image. Accordingly, the image processing apparatus 500 can adjust the size of the input image and determine the display position on the basis of the information of the input image and the specification of the display area 560*a*.

The image processing apparatus 500 transmits the output image generated by the output image generation unit 506 to the reproduction apparatus 560. Accordingly, the reproduction unit 507 of the reproduction apparatus 560 can display the output image from the display area 560*a*.

Even the image processing apparatus 500 having the configuration as described above can make the user feel as if the object in the full-size image is in the same space as the viewer viewing the image displayed on the display and feel that the object is closer to the real thing, similar to the image processing apparatus 100.

Modified Example 5-1

Figure 24:
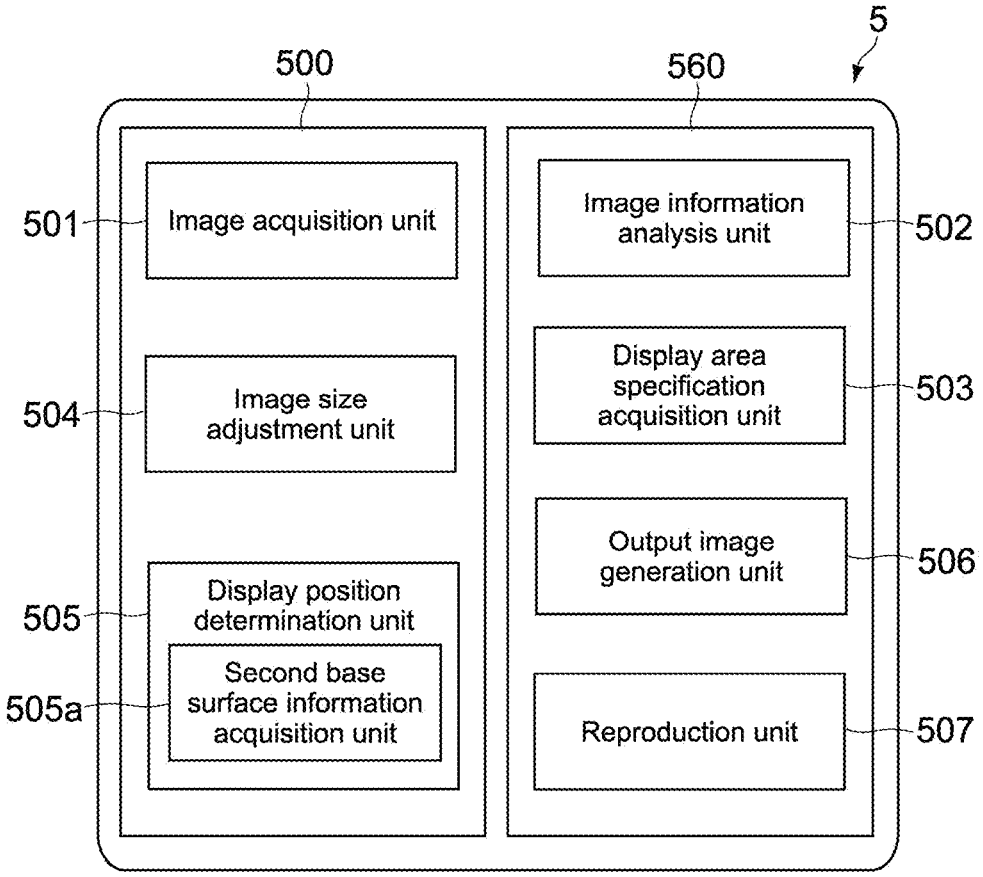
FIG. 24 A block diagram showing a functional configuration of the image processing apparatus according to a modified example 5-1.

As shown in FIG. 24, the image processing apparatus 500 may include the image acquisition unit 501, the image size adjustment unit 504, and the display position determination unit 505, and the reproduction apparatus 560 may include the image information analysis unit 502, the display area specification acquisition unit 503, the output image generation unit 506, and the reproduction unit 507. With this configuration, the image processing apparatus 500 transmits the full-size image and the information on the display position determined by the display position determination unit 505 to the reproduction apparatus 560 as in the fourth embodiment. As a result, the output image generation unit 506 of the reproduction apparatus 560 can generate an output image on the basis of the full-size image and the information on the display position, and the reproduction unit 507 can display the output image from the display area 560*a*.

Modified Example 5-2

Figure 25:
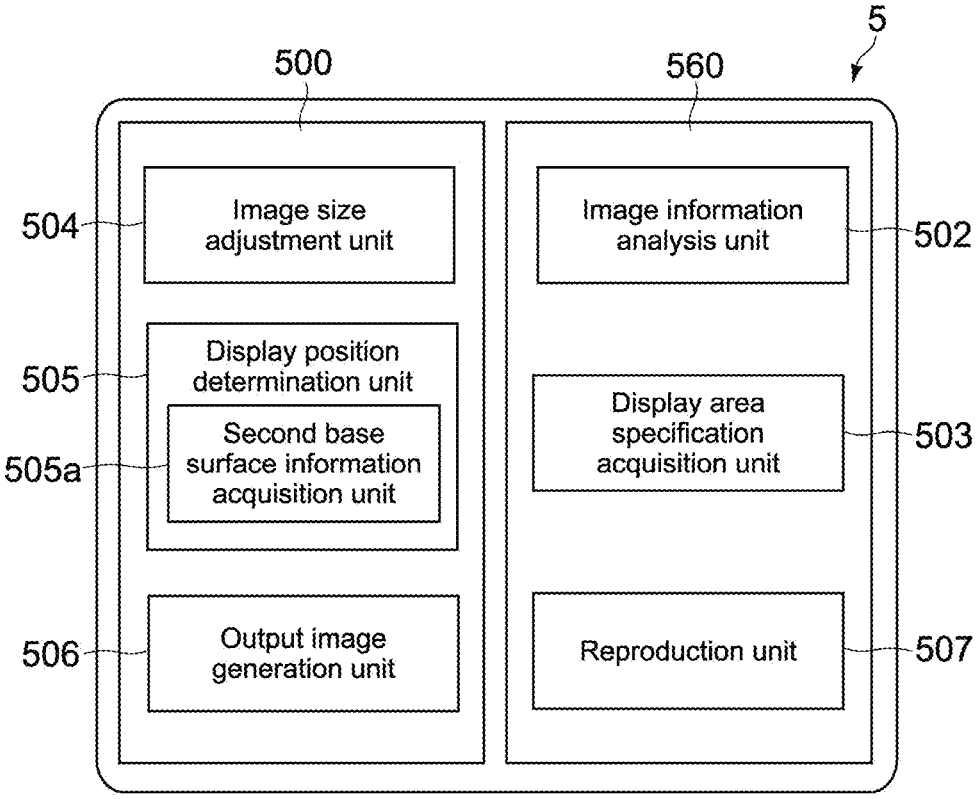
FIG. 25 A block diagram showing a functional configuration of the image processing apparatus according to a modified example 5-2.

As shown in FIG. 25, the image processing apparatus 500 may include the image size adjustment unit 504, the display position determination unit 505, and the output image generation unit 506 and not the image acquisition unit 501. With this configuration, the image processing apparatus 500 can carry out the processing on the basis of the image information analyzed by the image information analysis unit 502 without using the input image.

Further, the present technology is not limited to the embodiments described above and can be variously modified without departing from the gist of the present disclosure. Moreover, the first to fifth embodiments and modified examples described above may be combined anyhow as long as no contradiction is caused.

It should be noted that the present technology may also take the following configurations.

(1) An image processing apparatus, including:

an image size adjustment unit that adjusts a size of an input image so that an object of the input image is displayed in full size from a display area; and a display position determination unit that determines, on the basis of a positional relationship between a first base surface of a space where the display area exists and the display area, a display position of a full-size image in the display area, the full-size image being obtained by adjusting the size of the input image.

(2) The image processing apparatus according to (1), in which the display position determination unit includes a second base surface information acquisition unit that acquires, from the full-size image, information on a position of a second base surface of a space where the object exists, and determines the display position while enabling the position of the first base surface and the position of the second base surface in the full-size image to match.

(3) The image processing apparatus according to (2), in which the second base surface information acquisition unit includes a second base surface judgment unit that judges whether the second base surface is captured in the full-size image, and a second base surface detection unit that detects the position of the second base surface from the full-size image when judged that the second base surface is captured in the full-size image.

(4) The image processing apparatus according to any one of (1) to (3), further including a first base surface detection unit that detects a distance between the display area and the first base surface, in which the display position determination unit determines the display position on the basis of the detected distance.

(5) The image processing apparatus according to any one of (1) to (4), in which the display position determination unit includes a gaze area detection unit that detects an area to be gazed by a user out of the full-size image, and determines the display position such that the gaze area in the full-size image can be displayed from the display area.

(6) The image processing apparatus according to any one of (1) to (5), further including an image information analysis unit that analyzes information of the input image including information on the object, in which the image size adjustment unit adjusts the size of the input image on the basis of the information of the input image.

(7) The image processing apparatus according to (6), in which the image specification analysis unit includes a metadata acquisition unit that acquires metadata recorded onto the input image, and the image size adjustment unit adjusts the size of the input image on the basis of a specification of the display area and the metadata.

(8) The image processing apparatus according to (6) or (7), in which the image specification analysis unit includes an object information acquisition unit that acquires information on a size of the object, and the image size adjustment unit adjusts the size of the input image on the basis of a specification of the display area and the information on the size of the object.

(9) The image processing apparatus according to any one of (1) to (8), further including a display area specification acquisition unit that acquires a specification of the display area, in which the image size adjustment unit adjusts the size of the input image on the basis of the specification of the display area.

(10) The image processing apparatus according to any one of (1) to (9), further including an audio output control unit that controls, on the basis of the determined display position, an output position of audio associated with the full-size image.

(11) An image processing method, including:

adjusting a size of an input image so that an object of the input image is displayed in full size from a display area; and determining, on the basis of a positional relationship between a first base surface of a space where the display area exists and the display area, a display position of a full-size image in the display area, the full-size image being obtained by adjusting the size of the input image.

(12) A program that causes an information processing apparatus to execute the steps of:

adjusting a size of an input image so that an object of the input image is displayed in full size from a display area; and determining, on the basis of a positional relationship between a first base surface of a space where the display area exists and the display area, a display position of a full-size image in the display area, the full-size image being obtained by adjusting the size of the input image.

DESCRIPTION OF SYMBOLS

100, 200, 300, 400, 500 image processing apparatus
102, 302, 402, 502 image information analysis unit
102*a* metadata acquisition unit
102*b* object information acquisition unit
103, 303, 403, 503 display area specification acquisition unit
104, 304, 404, 504 image size adjustment unit
105, 305, 405, 505 display position determination unit
105*a*, 305*a*, 405*a*, 505*a* second base surface information acquisition unit
105*b* second base surface judgment unit
105*c* second base surface detection unit
105*d* gaze area detection unit
108 first base surface detection unit
209 audio output control unit

The invention claimed is:

1. An image processing apparatus, comprising:

one or more processors configured to:

adjust a size of an input image that includes an object;

obtain a full-size image of the object, to display on a display area, based on the adjusted size of the input image;

determine a display position of the full-size image in the display area, based on a positional relationship between a first position of a first base surface of a first space where the display area exists, and a second position of the display area, wherein the positional relationship corresponds to a distance between the first position of the first base surface and the second position of the display area;

acquire a third position of a second base surface of a second space where the object exists;

detect a line at a fourth position on the full-size image, wherein the fourth position of the line is above the third position of the second base surface;

enable the first position of the first base surface to match the third position of the second base surface in the full-size image; and enable the second position of the display area to match the fourth position of the line.

2. The image processing apparatus according to claim 1, wherein the one or more processors are further configured to:

capture the second base surface in the full-size image, and detect the third position of the second base surface from the full-size image based on the second base surface that is captured in the full-size image.

3. The image processing apparatus according to claim 1, wherein the one or more processors are further configured to:

detect a gaze area, that is gazed at, of the full-size image, and determine the display position such that the gaze area in the full-size image can be displayed on the display area.

4. The image processing apparatus according to claim 1, wherein the one or more processors are further configured to:

analyze information of the input image that includes information of the object, and adjust the size of the input image based on the information of the input image.

5. The image processing apparatus according to claim 4, wherein the one or more processors are further configured to:

acquire metadata recorded on the input image, and adjust the size of the input image based on a specification of the display area and the metadata.

6. The image processing apparatus according to claim 4, wherein the one or more processors are further configured to:

acquire information of a size of the object, and adjust the size of the input image based on a specification of the display area and the information on the size of the object.

7. The image processing apparatus according to claim 1, wherein the one or more processors are further configured to:

acquire a specification of the display area, and adjust the size of the input image based on the specification of the display area.

8. The image processing apparatus according to claim 1, wherein the one or more processors are further configured to:

control, based on the determined display position, an output position of audio associated with the full-size image.

9. An image processing method, comprising:

adjusting a size of an input image that includes an object;

obtaining a full-size image of the object, to display on a display area, based on the adjusted size of the input image;

determining a display position of the full-size image in the display area, based on a positional relationship between a first position of a first base surface of a space where the display area exists, and a second position of the display area, wherein the positional relationship corresponds to a distance between the first position of the first base surface and the second position of the display area;

acquiring a third position of a second base surface of a second space where the object exists;

detecting a line at a fourth position on the full-size image, wherein the fourth position of the line is above the third position of the second base surface;

enabling the first position of the first base surface to match the third position of the second base surface in the full-size image; and enabling the second position of the display area to match the fourth position of the line.

10. A non-transitory computer-readable medium having stored thereon, computer-executable instructions which when executed by an information processing apparatus, cause the information processing apparatus to execute operations, the operations comprising:

adjusting a size of an input image that includes an object;

obtaining a full-size image of the object, to display on a display area, based on the adjusted size of the input image;

determining a display position of the full-size image in the display area, based on a positional relationship between a first position of a first base surface of a first space where the display area exists, and a second position of the display area, wherein the positional relationship corresponds to a distance between the first position of the first base surface and the second position of the display area;

acquiring a third position of a second base surface of a second space where the object exists;

detecting a line at a fourth position on the full-size image, wherein the fourth position of the line is above the third position of the second base surface;

enabling the first position of the first base surface to match the third position of the second base surface in the full-size image; and enabling the second position of the display area to match the fourth position of the line.

* * * * *